US008252224B2

(12) United States Patent
Blain

(10) Patent No.: US 8,252,224 B2
(45) Date of Patent: Aug. 28, 2012

(54) METHODS OF ASSEMBLING MULTI-LAYERED DRINK-CONTAINERS

(75) Inventor: Christopher C. Blain, Petaluma, CA (US)

(73) Assignee: CamelBak Products, LLC, Petaluma, CA (US)

( * ) Notice: Subject to any disclaimer, the term of this patent is extended or adjusted under 35 U.S.C. 154(b) by 611 days.

(21) Appl. No.: 12/465,015

(22) Filed: May 13, 2009

(65) Prior Publication Data

US 2010/0288758 A1 Nov. 18, 2010

(51) Int. Cl.
*B29C 51/00* (2006.01)
*B29C 65/00* (2006.01)

(52) U.S. Cl. ..... 264/511; 264/512; 264/516; 264/571; 264/248; 264/296; 264/255; 264/229

(58) Field of Classification Search ..... None
See application file for complete search history.

(56) References Cited

U.S. PATENT DOCUMENTS

| | | | | |
|---|---|---|---|---|
| 1,475,439 | A | | 11/1923 | Lamassiaude |
| 1,673,446 | A | | 6/1928 | Eveleth |
| 2,024,065 | A | | 12/1935 | Schellens |
| 2,051,440 | A | | 8/1936 | Eicken |
| 2,338,604 | A | | 1/1944 | Silveyra |
| 2,591,578 | A | | 4/1952 | McNealy et al. |
| 2,643,021 | A | | 6/1953 | Freedman |
| 2,670,501 | A | * | 3/1954 | Michiels ..... 264/545 |
| 2,805,561 | A | | 9/1957 | Emmert et al. |
| 2,981,430 | A | | 4/1961 | Tsien et al. |
| 2,987,212 | A | | 6/1961 | Scanlon |
| 3,007,596 | A | | 11/1961 | Matsch |
| 3,039,648 | A | | 6/1962 | Busch |
| 3,079,027 | A | | 2/1963 | Edwards |
| 3,096,897 | A | | 7/1963 | Edwards |
| 3,113,831 | A | | 12/1963 | Coale |
| 3,119,543 | A | | 1/1964 | Walker |
| 3,149,742 | A | | 9/1964 | Hay et al. |
| 3,152,729 | A | | 10/1964 | Piker |
| 3,164,148 | A | | 1/1965 | Tolciss |
| 3,214,830 | A | | 11/1965 | Piker |
| 3,443,715 | A | | 5/1969 | Edwards |
| 3,450,254 | A | | 6/1969 | Miles |
| 3,456,860 | A | | 7/1969 | Janninck |

(Continued)

FOREIGN PATENT DOCUMENTS

EP 0276198 A2 7/1988

(Continued)

*Primary Examiner* — Edmund H. Lee
(74) *Attorney, Agent, or Firm* — DASCENZO Intellectual Property Law, P.C.

(57) ABSTRACT

Multi-layered drink-containers including an inner liquid-container and an outer shell in an at least partially overlapping, telescopic relation relative to the inner-liquid-container and methods of assembling the same. In some examples of multi-layered drink-containers, the inner liquid-container includes a lower portion having an outer cross-sectional area, an orthogonal projection of which at least partially overlaps an orthogonal projection of an inner cross-sectional area of an upper portion of the outer shell. Some examples of methods of assembling multi-layered drink-containers include reducing a resiliently deformable restrictive-portion of an inner liquid-container, positioning an outer shell in an at least partially overlapping, telescopic relation relative to the inner liquid-container, and returning the resiliently deformable restrictive-portion to a neutral, un-deformed and un-reduced state. In some methods, the reducing includes applying a vacuum to the internal volume of the inner liquid-container.

23 Claims, 3 Drawing Sheets

U.S. PATENT DOCUMENTS

| | | | | |
|---|---|---|---|---|
| 3,484,011 | A | | 12/1969 | Greenhalgh et al. |
| 3,655,502 | A | | 4/1972 | Yoshikawa |
| 3,720,558 | A | | 3/1973 | Menzies et al. |
| 3,760,972 | A | | 9/1973 | McKirnan |
| 3,840,153 | A | | 10/1974 | Devlin |
| 3,871,555 | A | | 3/1975 | Collins |
| 4,055,268 | A | | 10/1977 | Barthel |
| 4,196,721 | A | | 4/1980 | Posnansky |
| 4,196,817 | A | | 4/1980 | Moser |
| 4,212,408 | A | | 7/1980 | Valenzona |
| 4,330,066 | A | | 5/1982 | Berliner |
| 4,489,473 | A | | 12/1984 | Nakagami |
| 4,531,655 | A | | 7/1985 | Putnam |
| 4,548,348 | A | | 10/1985 | Clements |
| 4,549,410 | A | | 10/1985 | Russell |
| 4,581,804 | A | | 4/1986 | McLaughlin |
| 4,625,884 | A | | 12/1986 | Zimmermann |
| 4,629,098 | A | | 12/1986 | Eger |
| 4,635,814 | A | | 1/1987 | Jones |
| 4,705,085 | A | | 11/1987 | Brown |
| 4,708,254 | A | | 11/1987 | Byrns |
| 4,741,936 | A | | 5/1988 | Nohara et al. |
| 4,809,484 | A | | 3/1989 | Lovik |
| 4,871,597 | A | | 10/1989 | Hobson |
| 4,993,580 | A | | 2/1991 | Smith |
| 4,997,661 | A | | 3/1991 | Kromer et al. |
| 5,094,363 | A | | 3/1992 | Monahan et al. |
| 5,121,856 | A | | 6/1992 | Weiler et al. |
| 5,150,815 | A | | 9/1992 | Saklad |
| 5,188,787 | A | * | 2/1993 | King et al. ..... 264/153 |
| 5,221,016 | A | | 6/1993 | Karpal |
| 5,316,193 | A | | 5/1994 | Heiberger |
| 5,494,198 | A | | 2/1996 | Heiberger |
| 5,529,217 | A | | 6/1996 | Siegel |
| 5,567,377 | A | | 10/1996 | Nishigami et al. |
| 5,901,882 | A | | 5/1999 | Siegel |
| 5,906,300 | A | | 5/1999 | Horie |
| 6,141,941 | A | | 11/2000 | Carroll |
| 6,164,469 | A | | 12/2000 | Sartore |
| 6,337,052 | B1 | | 1/2002 | Rosenwasser |
| 6,474,499 | B2 | | 11/2002 | Donelson et al. |
| 6,537,244 | B2 | | 3/2003 | Paukovits et al. |
| 6,631,819 | B1 | | 10/2003 | Diak/Ghanem |
| 6,752,779 | B2 | | 6/2004 | Paukovits et al. |
| 7,270,244 | B1 | | 9/2007 | Liu |

FOREIGN PATENT DOCUMENTS

| | | |
|---|---|---|
| EP | 0291326 A1 | 11/1988 |

* cited by examiner

METHODS OF ASSEMBLING MULTI-LAYERED DRINK-CONTAINERS

FIELD OF THE DISCLOSURE

The present disclosure relates generally to drink containers, and more particularly to multi-layered drink-containers and methods of assembling multi-layered drink-containers.

BACKGROUND OF THE DISCLOSURE

For some time, people have recognized the need to stay hydrated. Conventionally, many individuals carry drink bottles that contain water or other potable beverages. Sometimes an individual may desire to maintain a cool temperature of a beverage, for example, during a summer outdoor activity. Conversely, sometimes an individual may desire to maintain a warm temperature of a beverage, for example, during a winter outdoor activity. In other situations, individuals simply may prefer a temperature of a beverage that is greater than or less than the ambient temperature.

SUMMARY OF THE DISCLOSURE

Multi-layered drink-containers according to the present disclosure include at least an inner liquid-container and an outer shell in an overlapping, telescopic relation to the inner liquid-container. Some examples of multi-layered drink-containers include an inner liquid-container with a resiliently deformable restrictive-portion that has an outer cross-sectional area that is greater than an inner cross-sectional area of a restrictive portion of an outer shell that is positioned longitudinally above the resiliently deformable restrictive-portion. Some examples of multi-layered drink-containers according to the present disclosure include a cap, or cap assembly, that is coupled, or selectively coupled, to at least one of the inner liquid-container and the outer shell. In some examples, one or more portions of the inner liquid-container and/or the outer shell are resiliently deformable. Some examples of multi-layered drink-containers according to the present disclosure include a sleeve positioned between the inner liquid-container and the outer shell.

Methods of assembling multi-layered drink-containers according to the present disclosure include reducing the resiliently deformable restrictive-portion of the inner liquid-container to permit the restrictive portion of the outer shell to be positioned longitudinally above the resiliently deformable restrictive-portion of the inner liquid-container and thus the outer shell to be in the overlapping, telescopic relation relative to the inner liquid-container. In some examples, the reducing includes reducing an outer cross-sectional area of the resiliently deformable restrictive-portion of the inner liquid-container. In some examples, the reducing includes reducing a maximum outer width of the resiliently deformable restrictive-portion of the inner liquid-container. In some examples of methods according to the present disclosure, the reducing includes applying a vacuum to an internal volume of the inner liquid-container.

DETAILED DESCRIPTION AND BEST MODE OF THE DISCLOSURE

Figure 1:
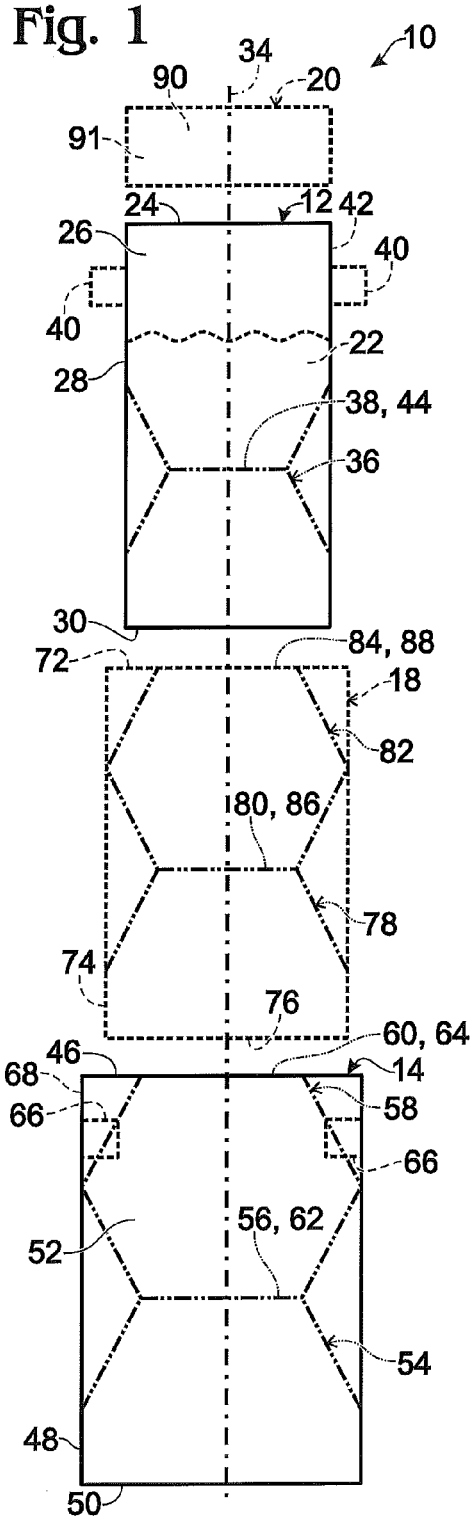
FIG. 1 is a schematic exploded view of multi-layered drink-containers according to the present disclosure.
Figure 2:
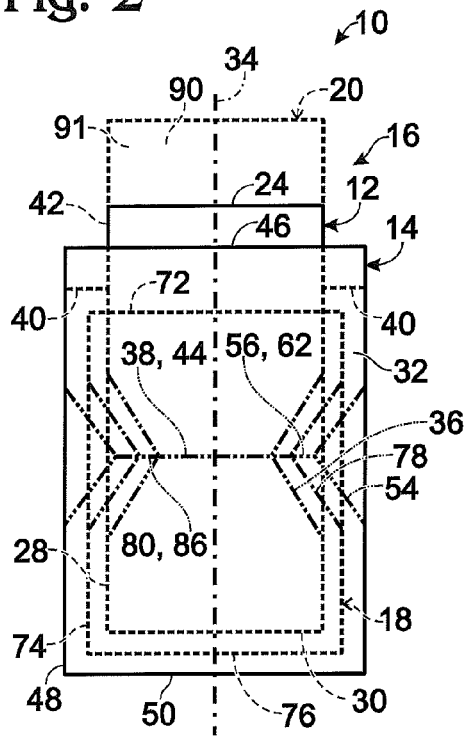
FIG. 2 is a schematic assembled view of illustrative, non-exclusive examples of multi-layered drink-containers according to the present disclosure.
Figure 3:
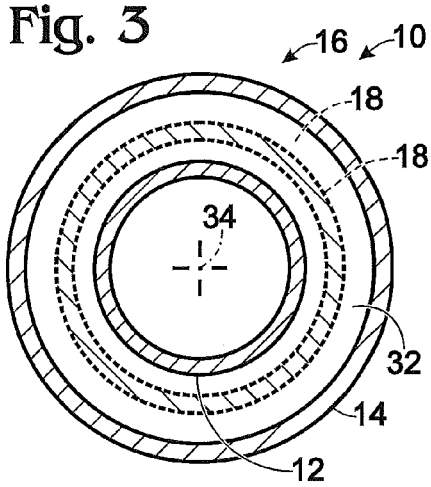
FIG. 3 is a schematic cross-sectional view of multi-layered drink-containers according to the present disclosure.

Multi-layered drink-containers according to the present disclosure are schematically illustrated in FIGS. 1-3 and are indicated generally at 10. Multi-layered drink-containers 10 according to the present disclosure are designed to receive and selectively dispense to a user a volume of potable drink liquid. Illustrative, non-exclusive examples of drink liquids that may be used with multi-layered drink-containers 10 according to the present disclosure include such potable liquids as water, juice, sports drinks, tea, and the like. Multi-layered drink-containers 10 include an inner liquid-container 12 and an outer shell 14 in an at least partially overlapping, telescopic relation relative to the inner liquid-container, as perhaps best seen in FIGS. 2-3. Inner liquid-container 12 and outer shell 14, when assembled, may collectively be referred to as a liquid container 16. In some embodiments of multi-layered drink-containers 10 according to the present disclosure, the at least partially overlapping relation may form a space, or cavity, 32 between the outer shell and the inner liquid-container. In some such embodiments, space 32 may be an at least partially enclosed space or even a fully enclosed space, depending on the attachment of the outer shell 14 to the inner liquid-container 12, as discussed herein. In other embodiments of multi-layered drink-containers 10 according to the present disclosure, the at least partially overlapping, telescopic relation may not form a space between the outer shell and the inner liquid-container, such that the outer shell substantially engages the inner-liquid container within the region of the at least partially overlapping, telescopic relation. Other configurations are also within the scope of the present disclosure, including configurations in which the liquid container includes at least one intermediate layer in the space between the inner liquid-container and the outer shell.

As schematically represented by dashed lines in FIGS. 1-3, multi-layered drink-containers 10 may additionally and optionally include one or more sleeves 18 positioned between the inner liquid-container and the outer shell. When present, the one or more sleeves may be described as also being in an at least partially overlapping, telescopic relation relative to the inner liquid-container, and the outer shell may likewise be described as being in an at least partially overlapping, telescopic relation relative to the optional one or more sleeves. Also as schematically represented by dashed lines in FIGS. 1-2, multi-layered drink-containers according to the present disclosure may optionally include a cap, or cap assembly, 20 that is coupled to or adapted to be selectively coupled to liquid container 16. That is, when present, cap 20 may be coupled to or adapted to be selectively coupled to one or both of the inner liquid-container and/or the outer shell. Illustrative, non-exclusive examples of suitable coupling mechanisms that may be utilized include threaded coupling mechanisms and snap-fit coupling mechanisms.

As used herein, "selective" and "selectively," when modifying an action, movement, configuration, or other activity of one or more components or characteristics of a multi-layered drink-container according to the present disclosure, means that the specified action, movement, configuration, or other activity is a direct or indirect result of user manipulation of an aspect of, or of one or more components of, the multi-layered drink-container.

Although not required to all embodiments, FIGS. 1-3 schematically illustrate inner liquid-container 12, outer shell 14, and optional sleeve(s) 18 as sharing a longitudinal axis 34, with FIG. 3 schematically illustrating inner liquid-container 12, outer shell 14, and optional sleeve(s) 18 all having a circular cross-section. However, it is also within the scope of the present disclosure that when assembled, the respective longitudinal axes are not necessarily co-axial. Further, it is within the scope of the present disclosure that inner liquid-container 12, outer shell 14, and optional sleeve(s) 18 have any suitable profile, including (but not limited to) circular, polygonal, elliptical, regular, irregular, etc. profiles. It is also within the scope of the present disclosure that one or more of inner liquid-container 12, outer shell 14, and optional sleeve (s) 18 have more than one cross-sectional profile longitudinally along its respective height. That is, one or more of an inner liquid-container, an outer shell, and optional sleeves of a multi-layered drink-container according to the present disclosure may have varying widths, cross-sectional areas, perimeters, etc. along its respective height, or longitudinal length. Additionally or alternatively, when the inner liquid-container, the outer shell, and optionally the optional sleeve (s) share a longitudinal axis, the inner liquid-container, the outer shell, and optionally the optional sleeve(s) may be described as being concentric within the region of the overlapping, telescopic relation of the outer shell relative to the inner-liquid container and relative to the optional sleeve(s).

Portions of inner liquid-container 12, outer shell 14, and optional sleeve(s) 18 may be described at least partially in terms of one or more widths or cross-sectional areas, with such widths and cross-sectional areas being defined within a plane that is transverse to the longitudinal axis of the respective inner liquid-container, outer shell, or sleeve. Herein, such a defined plane may be referred to as a transverse plane and the corresponding profile of a respective component may be referred to as a transverse profile. For example, as perhaps best seen in FIG. 3 with an inner liquid-container, outer shell, and optional sleeve each illustrated as having an illustrative, non-exclusive circular profile, each of the inner liquid-container, outer shell, and optional sleeve may be described as having an outer width and an inner width, with the difference equal to a wall thickness of the respective component. Additionally or alternatively, each of the inner liquid-container, outer shell, and optional sleeve may be described as having a cross-sectional area defined as being bound by one of an outer perimeter or an inner perimeter within the transverse profile of the respective component. That is, any given portion of an inner liquid-container, an outer shell, and a sleeve includes a cross-sectional area bound by an outer perimeter of the given portion and a cross-sectional area bound by an inner perimeter of the given portion. Accordingly, within any given transverse plane that is within the region of the overlapping, telescopic relation of the outer shell relative to the inner liquid-container and the optional sleeve(s), the outer and inner cross-sectional areas of the outer shell are greater than the outer and inner cross-sectional areas of the optional sleeve(s), which are greater than the outer and inner cross-sectional areas of the inner liquid-container.

Additionally or alternatively, regardless of the profile of a portion of an inner liquid-container, outer shell, and optional sleeve of a multi-layered drink-container according to the present disclosure (i.e., whether a circular, polygonal, elliptical, regular, irregular, etc. profile), a profile of a respective component within any given transverse plane may be described as having a maximum outer-width, a minimum outer-width, a maximum inner-width, and a minimum inner-width. For example, a portion with an irregular profile may include more than one inner width and more than one outer width, including a maximum inner-width, a minimum inner-width, a maximum outer width, and a minimum outer-width. Furthermore, within a transverse plane that is within the region of the overlapping, telescopic relation of the outer shell relative to the inner liquid-container and the optional sleeve (s), the maximum outer-width of the outer shell is greater than the maximum outer-width of the optional sleeve(s), which is greater than the maximum outer-width of the inner liquid-container. Additionally or alternatively, within such a transverse plane, the maximum inner-width of the outer shell may be greater than or equal to the maximum outer-width of the optional sleeve(s) and may be greater than or equal to the maximum outer-width of the inner liquid-container. Also, within such a transverse plane, the maximum inner-width of an optional sleeve may be greater than or equal to the maximum outer-width of the inner liquid-container.

Inner liquid-containers 12 according to the present disclosure are adapted to receive and hold, or otherwise contain, up to a predetermined volume of drink liquid 22 for selective consumption by a user. Inner liquid-containers 12 may include an open top, or opening, 24 through which drink liquid 22 may be selectively poured, or otherwise dispensed, into an internal compartment 26 of the inner liquid-container defined by a side wall, or walls, 28 and a closed bottom 30, and from which the drink liquid may be selectively dispensed from the internal compartment to a user.

Inner liquid-containers 12 may have any suitable shape and be formed from any suitable material or combination of materials to hold up to a predetermined volume of drink liquid. Illustrative, non-exclusive examples of suitable sizes, or capacities, of inner liquid-containers 12 (i.e., volume of drink liquid 22 able to be received into an inner liquid-container at one time) include 4 oz., 6 oz., 8 oz., 10 oz., 12 oz., 16 oz., 20 oz., 24 oz., 32 oz., 36 oz., 4-11 oz., 12-19 oz., 19-25 oz., 12-36 oz., 25-36 oz., and 10-70 oz. (with these illustrative examples referring to liquid (fluid) ounces of drink liquid that may be received at one time into an empty inner liquid-container). It is within the scope of the present disclosure that inner liquid-containers having different sizes, including sizes that are smaller than, larger than, or within the illustrative sizes and/or ranges presented above, may be used without departing from the scope of the present disclosure.

An illustrative, non-exclusive example of a material that may be used to construct inner liquid-containers 12, or a portion thereof, includes polypropylene or another material that permits the inner liquid-container, or portion thereof, to be selectively and reversibly collapsed during use. That is, inner liquid-containers 12 may be formed from a suitable resiliently deformable material that permits the inner liquid-container to be collapsed under pressure exerted by a user's hand, such as to squeeze the liquid container to urge drink liquid to be dispensed therefrom. Accordingly, inner liquid-containers 12 may be (but are not required to be) described as being at least semi-rigid. Additionally or alternatively, inner liquid-containers 12 according to the present disclosure may include one or more selectively deformable portions. Such illustrative, non-exclusive examples may permit opposing portions, such as opposing wall portions, of the inner liquid-container to be urged toward or even into contact with each other to reduce the volume of the inner liquid-container and thereby aid in the dispensing of drink liquid 22 therefrom. In such an embodiment, the inner liquid-container may be configured to return automatically to its prior configuration upon reduction of the pressure, or force, that was applied to urge the sides, or opposing wall portions, of the inner liquid-container toward each other.

As discussed, an inner liquid-container 12 according to the present disclosure may have more than one cross-sectional profile and/or varying widths, cross-sectional areas, perimeters, etc. longitudinally along its height. Accordingly, FIGS. 1-2 schematically illustrate in dash-dot-dot lines that inner liquid-container 12 may have one or more optional reduced, or narrowed, regions 36, relative to adjacent portions of the inner liquid-container. The dash-dot-dot line indicated at 38 and 44 schematically represents that an inner liquid-container according to the present disclosure may have an outer width 38 and/or an outer cross-sectional area 44 associated with reduced region 36 that are respectively less than an outer width and an outer cross-sectional area of another portion of the inner liquid-container.

As schematically illustrated in dashed lines in FIGS. 1-2, inner liquid-containers 12 according to the present disclosure may include coupling structure 40 that is configured to mate with corresponding structure of an outer shell 14. As schematically illustrated, coupling structure 40 may (but is not required to) be located proximate to, but spaced away from, open top 24 of the inner liquid-container. Coupling structure 40, when present, may take any suitable form that is adapted to maintain the outer shell 14 in the at least partially overlapping, telescopic relation relative to the inner liquid-container 12. Illustrative, non-exclusive examples of suitable coupling structure 40 include threads, friction-fit structure, snap-fit structure, one or more surfaces, or other structure, adapted to be adhered to corresponding structure of an outer shell, one or more surfaces, or other structure, adapted to be welded to corresponding structure of an outer shell, etc. Additionally or alternatively, as schematically illustrated in FIGS. 1-2, although not required, coupling structure 40 may extend out from, or otherwise be spaced out from, an adjacent portion of inner liquid-container 12, including outer wall(s) 28. Additionally or alternatively, coupling structure 40 may form part of, or otherwise be integral to, outer wall(s) 28. Although not required to all embodiments, it is within the scope of the present disclosure that coupling structure 40 may form a hermetic seal between the inner liquid-container and the outer shell. Coupling structure 40 may additionally or alternatively form a dishwasher-safe seal between the inner liquid-container and the outer shell. By this it is meant that the seal is maintained even after repeated exposure to the elevated temperatures experienced in conventional household dishwashers.

Inner liquid-containers 12 according to the present disclosure optionally may include a neck, or neck region, 42 that is adjacent to, or at least proximate to, open top 24 of the inner liquid-container and that is configured to be coupled to or selectively coupled to a cap 20, when present. Illustrative, non-exclusive examples of necks 42 according to the present disclosure may include threads adapted to mate with corresponding threads of a cap, snap-fit structure adapted to mate with corresponding snap-fit structure of a cap, or any other suitable structure adapted to be coupled to or selectively coupled to a corresponding cap 20.

As mentioned, outer shells 14 according to the present disclosure are adapted to be in an at least partially overlapping, telescopic relation relative to an inner liquid-container 12 according to the present disclosure. Outer shells 14 may include an open top, or opening, 46, a side wall, or walls, 48, and a bottom 50. Bottom 50 may be an open bottom or may be a closed bottom, which together with side wall(s) 48 define an internal volume 52 of the outer shell. Bottom 50 may be configured to support the multi-layered drink-container in an upright orientation, for example, on a flat or generally flat surface.

Outer shells 14 may have any suitable shape and be formed from any suitable material or combination of materials. An illustrative, non-exclusive example of a material that may be used to construct outer shells 14, or portions thereof, includes polypropylene or other material that permits the outer shell, or portion thereof, to be selectively and reversibly collapsed during use. That is, outer shells 14 may (but are not required to) be at least semi-rigid. Additionally or alternatively, outer shells 14 according to the present disclosure may include one or more selectively deformable portions. Such illustrative, non-exclusive examples may permit opposing portions, such as opposing wall portions of the outer shell, to be urged toward each other to reduce the volume of the inner liquid-container and thereby aid in the dispensing of drink liquid 22 therefrom. In such an embodiment, the outer shell may be configured to return automatically to its prior configuration upon reduction of the pressure, or force, that is applied to urge the sides, or opposing wall portions, of the outer shell toward each other. Additionally or alternatively, outer shells 14 may be constructed, or at least partially constructed, of a translucent or transparent material, of which polypropylene may be an illustrative, non-exclusive suitable example.

As discussed, an outer shell 14 according to the present disclosure may have more than one cross-sectional profile and/or varying widths, cross-sectional areas, perimeters, etc. longitudinally along its height. Accordingly, FIGS. 1-2 schematically illustrate in dash-dot-dot lines that outer shell 14 may have one or more optional reduced, or narrowed, regions. In FIGS. 1-2, a first optional reduced region 54 is illustrated as being spaced away from the open top 46 of the outer shell. The dash-dot-dot line indicated at 56 and 62 schematically represents that an outer shell according to the present disclosure may have a minimum inner width 56 and/or an inner cross-sectional area 62 associated with reduced region 54 that are respectively less than an inner width and an inner cross-sectional area associated with another portion of the outer shell. In FIG. 1, a second optional reduced region 58 is illustrated as being adjacent to and defining the open top 46 of the outer shell. Reduced region 58 may have a minimum inner width 60 and/or an inner cross-sectional area 64 associated therewith that are respectively less than an inner width and an inner cross-sectional area associated with another portion of the outer shell. Additionally or alternatively, the open top 46 may be described as having a minimum inner-width 60 and/or an inner cross-sectional area 64.

In multi-layered drink-containers 10 according to the present disclosure, outer shells 14 may include a portion having a minimum inner-width that is less than a maximum outer-width of a lower portion of a corresponding inner liquid-container 12. As perhaps best seen in FIG. 2 with the schematic illustration of first optional reduced region 54, minimum inner-width 56 is less than the maximum outer-width of a lower portion of inner liquid-container 12. Additionally or alternatively, as seen in FIG. 1 with the schematic illustration of second optional reduced region 58, minimum inner-width 60 is less than the maximum outer-width of a lower portion of inner liquid-container 12.

Additionally or alternatively, outer shells 14 may include a portion having an inner cross-sectional area that is less than an outer cross-sectional area of a lower portion of a corresponding inner liquid-container 12. As perhaps best seen in FIG. 2 with the schematic illustration of first optional reduced region 54, inner cross-sectional area 62 is less than the inner cross-sectional area of a lower portion of inner liquid-container 12. Additionally or alternatively, as seen in FIG. 1 with the schematic illustration of second optional reduced region 58, inner cross-sectional area 64 is less than the inner cross-sectional area of a lower portion of inner liquid-container 12.

Additionally or alternatively, outer shells 14 may include a portion having an inner cross-sectional area, an orthogonal projection of which at least partially overlaps an orthogonal projection of an outer cross-sectional area of a lower portion of a corresponding inner liquid-container 12. Additionally or alternatively, the orthogonal projections of the inner cross-sectional area of the portion of the outer shell may at least partially overlap the orthogonal projection of the outer cross-sectional area of the lower portion of the corresponding inner liquid-container regardless of the radial orientation thereof. For example, as perhaps best seen in FIG. 2, an orthogonal projection of cross-sectional area 62 of first optional reduced region 54 of outer shell 14 would at least partially overlap an orthogonal projection of an outer cross-sectional area associated with bottom 30 of inner liquid-container 12.

Such portions of outer shells 14 that have an aspect (e.g., inner cross-sectional area, orthogonal projection thereof, and/or maximum inner-width) greater than (or overlapping) a corresponding aspect of a lower portion of an inner liquid-container 12 may be described as restrictive portions of outer shells 14. Similarly, such lower portions of inner liquid-containers also may be described as restrictive portions, and as disclosed herein may (but are not required to) be resiliently deformable to facilitate assembly of a multi-layered drink-container 10.

As schematically illustrated in dashed lines in FIG. 1, outer shells 14 according to the present disclosure may include coupling structure 66 that is configured to mate with corresponding structure of an inner liquid-container 12. Coupling structure 66 may be located adjacent to or proximate to (but spaced away from) open top 46 of the outer shell. Coupling structure 66, when present, may take any suitable form that is adapted to maintain the outer shell 14 in the at least partially overlapping, telescopic relation to the inner liquid-container 12. Illustrative, non-exclusive examples of suitable coupling structure 66 include threads, friction-fit structure, snap-fit structure, one or more surfaces, or other structure, adapted to be adhered to corresponding structure of an inner liquid-container, one or more surfaces, or other structure, adapted to be welded to corresponding structure of an inner liquid-container, etc. Additionally or alternatively, as schematically illustrated in FIG. 1, although not required, coupling structure 66 may extend in from, or otherwise be spaced in from, an adjacent portion of outer shell 14, including side wall(s) 48. Additionally or alternatively, coupling structure 66 may form part of, or otherwise be integral to, side wall(s) 48.

Outer shells 14 according to the present disclosure optionally may include a neck, or neck region, 68 that is adjacent to, or at least proximate to, open top 46 of the outer shell and that is configured to be coupled to or selectively coupled to a cap 20, when present. Illustrative, non-exclusive examples of necks 68 according to the present disclosure may include threads adapted to mate with corresponding threads of a cap, snap-fit structure adapted to mate with corresponding snap-fit structure of a cap, or any other suitable structure adapted to be coupled to or selectively coupled to a cap. In some such embodiments of multi-layered drink-containers 10 having an outer shell with a neck 68, inner liquid-container 12 may be fully disposed within the internal volume 52 of the outer shell. On the other hand, in embodiments of multi-layered drink-containers 10 having an inner liquid-container with a neck 42, as discussed above, inner liquid-container 12 may not be fully disposed within the internal volume 52 of the outer shell, as schematically illustrated in FIG. 2.

As mentioned, multi-layered drink-containers 10 according to the present disclosure may include at least one sleeve 18 that is positioned between inner liquid-container 12 and the outer shell 14 and in an at least partially, if not at least substantially, or completely, overlapping, telescopic relation relative to the inner liquid-container. That is, one or more sleeves 18 may be positioned within space 32 defined between the inner liquid-container and the outer shell of a multi-layered drink-container 10. Sleeve(s) 18 may include an open top, or opening, 72, a side wall, or walls, 74, and a bottom 76. Bottom 76 may be an open bottom or may be a closed bottom.

Sleeves 18 may have any suitable shape and be formed from any suitable material or combination of materials. Illustrative, non-exclusive examples of materials that may be used to construct sleeves 18 include materials selected for their insulating properties. For example, a sleeve 18 may be constructed of a material having a thermal resistance greater than the corresponding thermal resistance of air. Accordingly, a multi-layered drink-container 10 including one or more sleeves 18 positioned in space 32 may be configured to provide better insulating properties for maintaining a desired temperature of a drink liquid 22 than a multi-layered drink-container 10 without a sleeve 18 positioned in space 32. Illustrative, non-exclusive examples of insulating materials include (but are not limited to) polyethylene closed cell foam and aerogel materials.

In some embodiments, sleeves 18 may be constructed of a material that permits the sleeve, or a portion thereof, to be selectively and reversibly collapsed during use. That is, sleeves 18 may (but are not required to) be at least semi-rigid. Additionally or alternatively, sleeves 18 according to the present disclosure may include one or more selectively deformable portions.

Additionally or alternatively, sleeves 18 according to the present disclosure may be constructed of a flexible material. In such embodiments, the sleeve(s) 18 may generally conform to the shape of the space 32, or at least to a portion of space 32.

Additionally or alternatively, sleeves 18 according to the present disclosure may have a multi-layered construction including one or more materials. For example, a sleeve 18 may be constructed of a polyethylene closed cell foam having a thin sheet of polyethylene adhered thereto. Other configurations are also within the scope of the present disclosure.

Although schematically illustrated in FIG. 3 as in a spaced relation relative to the inner liquid-container 12 and the outer shell 14, it is within the scope of the present disclosure that one or more sleeves 18 engage one or both of the outside surface of the inner liquid-container and the inside surface of the outer shell. It is also within the scope of the present disclosure that a material substantially fills space 32, with such material forming a sleeve 18, as schematically indicated with a dashed lead line in FIG. 3.

As discussed, a sleeve 18 according to the present disclosure may have more than one cross-sectional profile and/or varying widths, cross-sectional areas, perimeters, etc. longitudinally along its height. Accordingly, FIGS. 1-2 schematically illustrate in dash-dot-dot lines that sleeve 18 may have one or more optional reduced, or narrowed, regions. In FIGS. 1-2, a first optional reduced region 78 is illustrated as being spaced away from the open top 72 of the sleeve and may be described as having a minimum inner-width 80 and/or an inner cross-sectional area 86. In FIG. 1, a second optional reduced region 82 is illustrated as being adjacent to and defining open top 72 of the sleeve and may be described as having a minimum inner-width 84 and/or an inner cross-sectional area 88. Additionally or alternatively, the open top 72 may be described as having a minimum inner-width 84 and/or an inner cross-sectional area 88.

Some multi-layered drink-containers 10 according to the present disclosure that include a sleeve 18, such a sleeve may (but is not required to) include a portion having a minimum inner-width that is less than a maximum outer-width of a portion of a corresponding inner liquid-container 12, with such a portion of the inner liquid-container having the maximum outer-width being longitudinally below the portion of the sleeve having the minimum inner-width. As perhaps best seen in FIG. 2 with the schematic illustration of first optional reduced region 78, minimum inner-width 80 is less than the maximum outer-width of a lower portion of inner liquid-container 12. Additionally or alternatively, as seen in FIG. 1 with the schematic illustration of second optional reduced region 82, minimum inner-width 84 is less than the maximum outer-width of a lower portion of inner liquid-container 12.

Additionally or alternatively, a sleeve 18 may include a portion having an inner cross-sectional area that is less than an outer cross-sectional area of a lower portion of a corresponding inner liquid-container 12. As perhaps best seen in FIG. 2 with the schematic illustration of first optional reduced region 78, inner cross-sectional area 86 is less than the inner cross-sectional area of a lower portion of inner liquid-container 12. Additionally or alternatively, as seen in FIG. 1 with the schematic illustration of second optional reduced region 82, inner cross-sectional area 88 is less than the inner cross-sectional area of a lower portion of inner liquid-container 12.

Additionally or alternatively, a sleeve 18 may include a portion having an inner cross-sectional area, an orthogonal projection of which at least partially overlaps an orthogonal projection of an outer cross-sectional area of a lower portion of a corresponding inner liquid-container 12. Additionally or alternatively, the orthogonal projections of the inner cross-sectional area of the portion of the sleeve may at least partially overlap the orthogonal projection of the outer cross-sectional area of the lower portion of the corresponding inner liquid-container, regardless of the radial orientation thereof. For example, as perhaps best seen in FIG. 2, an orthogonal projection of cross-sectional area 86 of first optional reduced region 78 of sleeve 18 would at least partially overlap an orthogonal projection of an outer cross-sectional area associated with bottom 30 of inner liquid-container 12.

As mentioned, multi-layered drink-containers 10 according to the present disclosure may optionally include a cap, or cap assembly, 20 that is coupled to, or removably coupled to, a liquid container 16. When present, a cap 20 may cover, or otherwise enclose, one or both of the open top 24 of inner liquid-container 12 and the open top 46 of outer shell 14. When so coupled, a cap 20 restricts drink liquid 22 within the inner liquid-container's internal compartment 26 from being dispensed from the liquid container other than through an optional liquid passage 90 defined by the cap 20.

Although not required in all embodiments, cap 20, when present, is typically removably coupled to liquid container 16, such as to one of optional neck 42 of inner liquid-container 12 or optional neck 68 of outer shell 14, to permit selective and non-destructive removal and replacement (i.e., uncoupling and recoupling) of the cap relative to the liquid container 16. For example, cap 20 may be uncoupled from the liquid container to permit the inner liquid-container to receive a volume of drink liquid, after which the cap assembly may be recoupled to the liquid container 16. Accordingly, caps 20 according to the present disclosure may include coupling structure that is adapted to selectively mate with one of optional neck 42 of inner liquid-container 12 or optional neck 68 of outer shell 14. Illustrative, non-exclusive examples of such coupling structure include threads adapted to mate with corresponding threads of a liquid container 16, snap-fit structure adapted to mate with corresponding snap-fit structure of a liquid container 16, or any other suitable structure adapted to be coupled to or selectively coupled to a liquid container 16.

Additionally or alternatively, a cap 20 may include a mouthpiece 91 that at least partially defines optional liquid passage 90 through which drink liquid may be dispensed to a user from the inner liquid-container. Mouthpiece 91, when present, may take any suitable form, including (but not limited to) a mouthpiece that includes a user-actuated valve adapted to permit selective dispensing of drink liquid from the multi-layered drink-container, mouthpieces that permit a user to draw, or suck, drink liquid from the multi-layered drink-container, mouthpieces that permit a user to squeeze drink liquid from the multi-layered drink-container, and/or other configurations of mouthpieces. Illustrative, non-exclusive examples of such mouthpieces include mouthpieces with a push/pull valve mechanism, mouthpieces with a bite-valve, and mouthpieces with a valve that opens in response to a user applying pressure to opposing sides of, or otherwise squeezing, a multi-layered drink-container 10. Additional illustrative, non-exclusive examples of suitable cap assemblies and/or mouthpieces are disclosed in U.S. patent application Ser. No. 11/313,488, the disclosure of which is hereby incorporated by reference.

Figure 4:
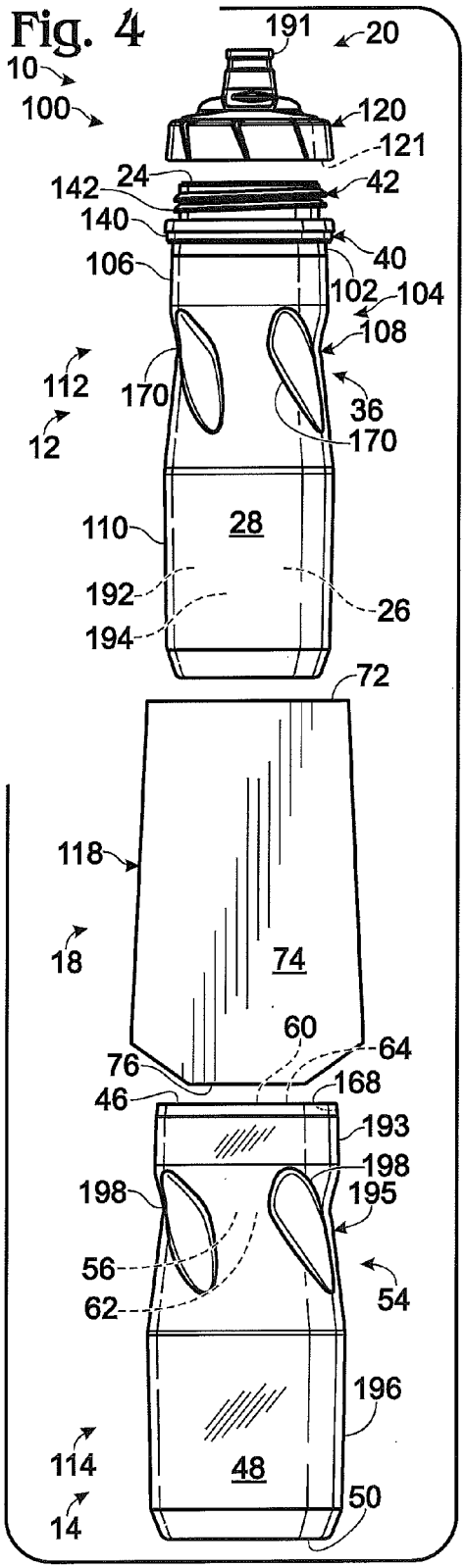
FIG. 4 is an exploded view of an unassembled illustrative, non-exclusive example of a multi-layered drink-container according to the present disclosure.
Figure 5:
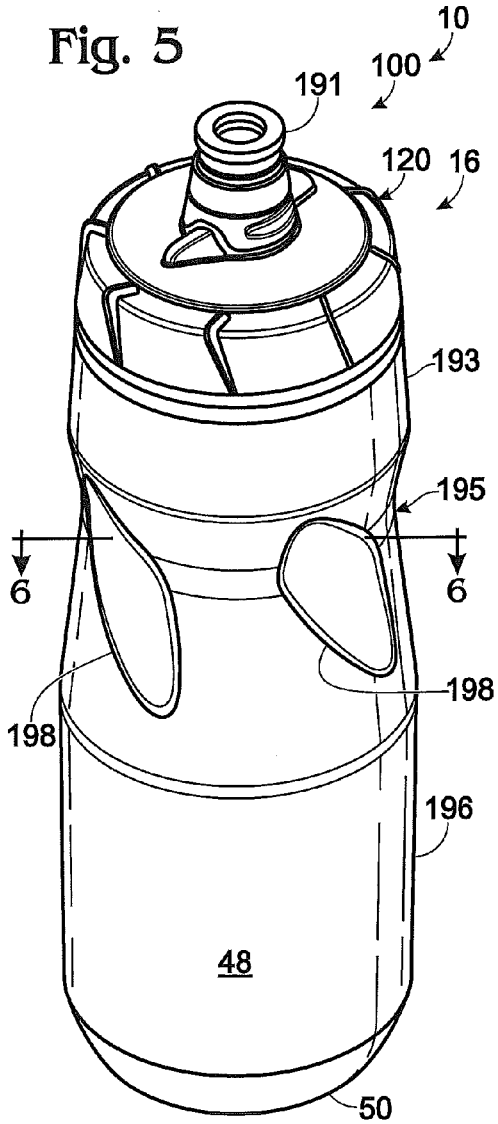
FIG. 5 is an isometric side view of the multi-layered drink-container of FIG. 4.
Figure 6:
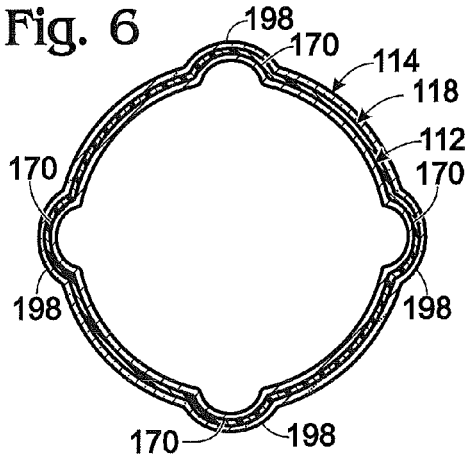
FIG. 6 is a cross-sectional view of the multi-layered drink container of FIG. 4 taken along the line 6-6 of FIG. 5.

Turning now to FIGS. 4-6, an illustrative, non-exclusive example of a multi-layered drink-container 10 according to the present disclosure is illustrated and generally indicated at 100, and may be referred to as a multi-layered drink-bottle 100. Where appropriate, the reference numerals from the schematic illustrations of FIGS. 1-3 are used to designate corresponding parts of multi-layered drink-containers 10 according to the present disclosure; however, the example of FIGS. 4-6 is non-exclusive and does not limit the present disclosure to the illustrated embodiment. That is, neither multi-layered drink-containers nor various component parts thereof according to the present disclosure are limited to the specific embodiment disclosed and illustrated in FIGS. 4-6, and multi-layered drink-containers according to the present disclosure may incorporate any number of the various aspects, configurations, characteristics, properties, etc. illustrated in the embodiments of FIGS. 1-6, as well as variations thereof and without requiring the inclusion of all such aspects, configurations, characteristics, properties, etc. For the purpose of brevity, each previously discussed component part, or variant thereof, may not be discussed again with respect to FIGS. 4-6; however, it is within the scope of the present disclosure that the previously discussed features, materials, variants, etc. may be utilized with the illustrated embodiment of FIGS. 4-6. Similarly, it is also within the scope of the present disclosure that all of the component parts, and portions thereof, that are illustrated in FIGS. 4-6 are not required to all embodiments according to the present disclosure.

Multi-layered drink-bottle 100 includes an inner liquid-container 12 in the form of a resiliently deformable inner liquid-container 112, an outer shell 14 in the form of a resiliently deformable outer shell 114, an optional sleeve 18 in the form of an insulating sleeve 118, and a cap 20 in the form of a cap assembly 120. Although not required to be, multi-layered drink-bottle 100 is configured as a bike bottle. That is, multi-layered drink-bottle 100 is shaped and sized to operatively be received within typical bottle cages that are often mounted on bicycles.

Inner liquid-container 112 is a semi-rigid, resiliently deformable inner liquid-container 12 constructed of polypropylene. Inner liquid-container 112 includes a neck 42 that defines an open top 24, through which a volume of drink fluid may be selectively dispensed into internal compartment 26 of inner liquid-container 112. Neck 42 includes external threads 142 adapted to mate with corresponding internal threads of cap assembly 120.

Longitudinally below and proximate to neck 42, inner liquid-container 112 includes coupling structure 40 in the form of an outer-facing cylindrical surface 140 that is laser-welded and hermetically sealed to a corresponding inner-facing cylindrical surface 168 of outer shell 114. Outer-facing cylindrical surface 140 is radially spaced out from an adjacent portion 102 of side wall 28 of inner liquid-container 112 that is longitudinally below outer-facing cylindrical surface 140. The entirety of the portion of inner liquid-container 112 that is longitudinally below outer-facing cylindrical surface 140 may be described as a lower portion 104. Lower portion 104 includes an upper lower-portion 106, an intermediate lower-portion 108, and a lower lower-portion 110.

Intermediate lower-portion 108 may be described as an optional reduced region 36, and includes four radially spaced, outwardly projecting surface features 170. As perhaps best seen in FIG. 6, a transverse profile of inner liquid-container 112 that intersects surface features 170 is non-circular.

Lower lower-portion 110 includes a maximum outer-width (outer diameter) 192 and an outer cross-sectional area 194.

Outer shell 114 is a semi-rigid, resiliently deformable outer shell 14 constructed of polypropylene that may be at least partially translucent. Outer shell 114 includes an open top 46, a side wall 48, and a closed bottom 50. The open top of outer shell 114 has a maximum inner-width (inner diameter) 60 that is less than the maximum outer-width (outer diameter) 192 of the lower lower-portion 110 of inner liquid-container 112, at least when lower lower-portion 110 is in a non-deformed, neutral state. The open top 46 of outer shell 114 also has an inner cross-sectional area 64 that is less than the outer cross-sectional area 194 of the lower lower-portion 110 of inner liquid-container 112, at least when lower lower-portion 110 is in a non-deformed, neutral state.

Adjacent to its open top, outer shell 114 includes the mentioned inner-facing cylindrical surface 168 that is laser-welded and hermetically sealed to outer-facing cylindrical surface 140 of inner liquid-container 112.

Outer shell 114 includes an upper portion 193, an intermediate portion 195, and a lower portion 196, which generally correspond to upper lower-portion 106, intermediate lower-portion 108, and lower lower-portion 110 of inner liquid-container 112, respectively. Intermediate portion 195 may be described as an optional reduced region 54, and includes four radially spaced, outwardly projecting surface features 198. It is within the scope of the present disclosure that a greater or lesser number of surface features, including no surface features, 198 may be utilized in a particular embodiment. As perhaps best seen in FIG. 6, a transverse profile of outer shell 114 that intersects surface features 198 is non-circular. Intermediate portion 195 has a minimum inner-width (inner diameter) 56 that is less than the maximum outer-width (outer diameter) 192 of the lower lower-portion 110 of inner liquid-container 112, at least when lower lower-portion 110 is in a non-deformed, neutral state. Intermediate portion 195 also has an inner cross-sectional area 62 that is less than the outer cross-sectional area 194 of the lower lower-portion 110 of inner liquid-container 112, at least when lower lower-portion 110 is in a non-deformed, neutral state.

Insulating sleeve 118 is a flexible sleeve constructed of a layer of polyethylene closed cell foam adhered to a thin layer of sheet polyethylene. The thin layer of sheet polyethylene may be provided for indicia (e.g., branding, graphics, and the like) to be imprinted thereon and viewable through the side wall 48 of outer shell 114. Sleeve 118 is illustrated in FIG. 4 in a relaxed, pre-assembled configuration. That is, the construction of sleeve 118 may be described as an envelope formed by a side wall 74 and a closed bottom 76 and having an open top 72, and which, when positioned between inner liquid-container 112 and outer shell 114, generally takes the form of the enclosed space between inner liquid-container 112 and outer shell 114, as illustrated in FIG. 6.

The open top 72 of insulating sleeve 118 has a maximum inner-width, or diameter, (defined when multi-layered drink-bottle 100 is assembled) that is less than the maximum outer-width (outer diameter) 192 of the lower lower-portion 110 on inner liquid-container 112, at least when lower lower-portion 110 is in a non-deformed, neutral state. The open top 72 of insulating sleeve 118 also has an inner cross-sectional area (defined when multi-layered drink-bottle 100 is assembled) that is less than the outer cross-sectional area 194 of the lower lower-portion 110 of the inner liquid-container 112, at least when the lower lower-portion 110 is in a non-deformed, neutral state.

Cap assembly 120, as mentioned, is adapted to be selectively coupled to and from neck 42 of inner liquid-container 118. As such, cap assembly 120 includes internal threads 121 that correspond to external threads 142 of inner liquid-container 112. Cap assembly 120 also includes a mouthpiece 123 that is adapted to dispense drink liquid from the inner liquid-container 112 upon a user applying pressure to opposing sides of, or otherwise squeezing, outer shell 114.

Figure 7:
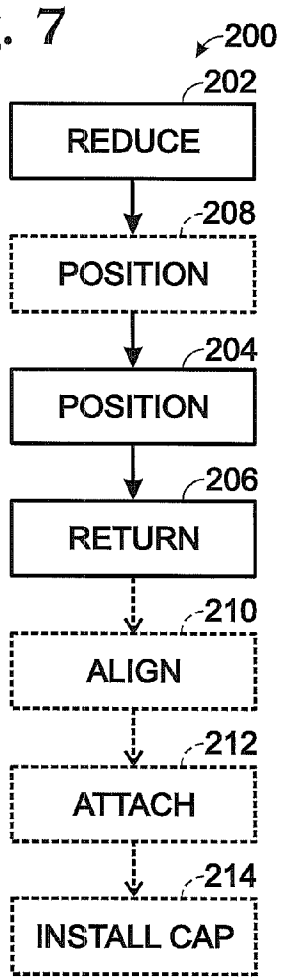
FIG. 7 is a flow-chart illustrating illustrative, non-exclusive examples of methods of assembling multi-layered drink-containers according to the present disclosure.

Turning now to FIG. 7, illustrative, non-exclusive examples of methods of assembling multi-layered drink-containers according to the present disclosure are schematically illustrated and are generally indicated at 200. Methods 200 according to the present disclosure may be suitable for assembling one or more illustrative, non-exclusive examples of multi-layered drink-containers 10 according to the present disclosure, as disclosed herein. That is, some methods 200 according to the present disclosure may be suitable for assembling only a subset of the disclosed various examples and alternative embodiments of multi-layered drink-containers 10 according to the present disclosure. Additionally or alternatively, multi-layered drink-containers according to the present disclosure may be assembled by one or more methods not disclosed herein, and multi-layered drink-containers 10 according to the present disclosure are not limited to being assembled only according to a method 200 according to the present disclosure. Where appropriate in describing methods 200 according to the present disclosure, the reference numerals of component parts or characteristics thereof of multi-layered drink-containers 10 according to the present disclosure schematically illustrated in FIGS. 1-3 may be included to give context to the methods and steps thereof.

Methods 200 according to the present disclosure specifically relate to the assembly of a multi-layered drink-container 10 according to the present disclosure that includes at least an inner liquid-container 12 and an outer shell 14, with the inner liquid-container including a resiliently deformable portion having an outer cross-sectional area that is greater than an inner cross-sectional area of a portion of the outer shell that is longitudinally above the resiliently deformable portion of the inner liquid-container, at least when the resiliently deformable portion of the inner liquid-container is in a neutral, un-deformed state. Such a resiliently deformable portion of an inner liquid-container may be described as a resiliently deformable restrictive-portion, because the resiliently deformable restrictive-portion generally restricts positioning the outer shell relative to the inner liquid-container to form a multi-layered drink-container according to the present disclosure. That is, the resiliently deformable restrictive-portion is too large to fit through the necessary portion, or portions, of the outer shell to fully assemble the multi-layered drink-container 10, at least without deformation of the resiliently deformable restrictive-portion thereof. Such portions of the outer shell may similarly be described as restrictive portions. Optional sleeves 18 may also include such restrictive portions.

Accordingly, methods 200 according to the present disclosure at least include (i) reducing the resiliently deformable restrictive-portion of an inner liquid-container 12, as indicated at 202, (ii) after the reducing 202, positioning an outer shell 14 in an at least partially overlapping, telescopic relation relative to the inner liquid-container, as indicated at 204, and (iii) after the positioning 204, returning the resiliently deformable restrictive-portion to a neutral, un-deformed and non-reduced state, as indicated at 206. As indicated in dashed boxes in FIG. 7, methods 200 according to the present disclosure may additionally and optionally include one or more of (i) after reducing 202 and before positioning 204, positioning one or more sleeve 18 in an at least partially overlapping, telescopic relation relative to the inner liquid-container, as indicated at 208, (ii) after positioning 204, radially aligning the outer shell relative to the inner liquid-container, as indicated at 210, (iii) after positioning 204, attaching the outer shell to the inner liquid-container, as indicated as 212, and (iv) installing a cap 20 to one of the inner liquid-container and the outer shell, as indicated at 214.

Reducing 202 may be described in terms of reducing the outer cross-sectional area of the resiliently deformable restrictive-portion of the inner liquid-container from a neutral cross-sectional area to a reduced cross-sectional area in which an orthogonal projection of the reduced cross-sectional area does not overlap an orthogonal projection of the cross-sectional area of a restrictive portion of the outer shell. In such a method, the orthogonal projection of the cross-sectional area of the resiliently deformable portion may also at least partially overlap the orthogonal projection of the cross-sectional area of the portion of the outer shell regardless of radial orientation thereof, and the orthogonal projection of the reduced cross-sectional area may not overlap the orthogonal projection of the cross-sectional area of the restrictive portion of the outer shell in at least one radial orientation.

Additionally or alternatively, reducing 202 may be described in terms of reducing the cross-sectional area of the resiliently deformable restrictive-portion of the inner liquid-container from a neutral cross-sectional area, in which the resiliently deformable restrictive-portion is in a neutral, un-deformed state, to a reduced cross-sectional area, in which the restrictive portion of the outer shell does not restrict positioning the outer shell in the at least partially overlapping, telescopic relation relative to the inner liquid-container.

Additionally or alternatively, reducing 202 may include reducing the maximum outer-width of the resiliently deformable restrictive-portion of the inner liquid-container from a neutral maximum-outer-width to a reduced maximum-outer-width that is less than or equal to the minimum inner-width of the restrictive-portion of the outer shell.

Additionally or alternatively, reducing 202 may include collapsing the resiliently deformable restrictive-portion of the inner liquid-container to reduce the cross-sectional area and/or the maximum outer-width thereof so that the outer shell can be positioned in the at least partially overlapping, telescopic relation relative to the inner liquid-container.

Additionally or alternatively, reducing 202 may include applying a width-reducing force to the resiliently deformable restrictive-portion of the inner-liquid container to reduce the cross-sectional area and/or the maximum outer-width of the resiliently deformable restrictive-portion of the inner liquid-container so that the outer shell can be positioned in the at least partially overlapping, telescopic relation relative to the inner liquid-container. In such a method, returning 206 may include releasing the width-reducing force so that the cross-sectional area and/or the maximum outer-width of the resiliently deformable restrictive-portion return to a neutral state.

Additionally or alternatively, reducing 202 may include applying a volume-reducing force to the resiliently deformable restrictive-portion of the inner liquid-container to reduce the internal volume and/or the maximum outer-width of the inner liquid-container so that the outer shell can be positioned in the at least partially overlapping, telescopic relation relative to the inner liquid-container. In such a method, returning 206 may include releasing the volume-reducing force so that the cross-sectional area and/or the maximum outer-width of the resiliently deformable restrictive-portion return to a neutral state.

Additionally or alternatively, reducing 202 may include applying a vacuum to an internal volume of the inner liquid-container to reduce the internal volume, the cross-sectional area, and/or the maximum outer-width of the resiliently deformable restrictive-portion of the inner liquid-container so that the outer shell can be positioned in the at least partially overlapping, telescopic relation relative to the inner liquid-container. In such a method, returning 206 may include releasing the vacuum so that the cross-sectional area and/or the maximum outer-width of the resiliently deformable restrictive-portion return to a neutral state.

Positioning 204 may be described in terms of positioning the outer shell in the at least partially overlapping, telescopic relation relative to the inner liquid-container such that the inner liquid-container extends at least partially within the outer shell so that the restrictive portion of the outer shell is longitudinally beyond the resiliently deformable restrictive-portion of the inner liquid-container.

Additionally or alternatively, positioning 204 may include inserting the inner liquid-container into the outer shell. Additionally or alternatively, positioning 204 may include positioning the outer shell at least partially around the inner liquid-container. Additionally or alternatively, positioning 204 results in an at least partially overlapping, telescopic relation between the inner liquid-container and the outer shell in which the longitudinal axis on the inner liquid-container and the longitudinal axis of the outer shell are at least approximately coaxial. Additionally or alternatively, positioning 204 results in a relation between the inner liquid-container and the outer shell in which the inner liquid-container is partially within the outer shell. Additionally or alternatively, positioning 204 results in a relation in which the inner liquid-container is completely within the outer shell.

As mentioned, some methods according to the present disclosure further and optionally include (after reducing 202 and before positioning 204) the positioning 208 of one or more sleeves 18 in an at least partially overlapping, telescopic relation relative to the inner liquid-container. In some examples of methods according to the present disclosure, positioning 208 may result in a relation in which the inner liquid-container extends at least partially within the sleeve. In some examples of methods according to the present disclosure, the sleeve may include a restrictive portion that has an inner cross-sectional area and/or a maximum inner-width that generally restricts positioning of the sleeve relative to the inner liquid-container at least without the reducing 202 of the inner liquid-container.

As disclosed herein, some examples of multi-layered drink-containers according to the present disclosure include one or more portions with non-circular transverse profiles. For example, a non-circular portion of an inner liquid-container 12 may include a non-circular profile that corresponds to, or aligns with, a non-circular portion of an outer shell 14 having a non-circular profile. Assembly of such embodiments therefore may include radially aligning the outer shell relative to the inner liquid-container, as indicated at 210 in FIG. 7. Aligning 210 may be described in terms of aligning the non-circular profile of the non-circular portion of the outer shell with the non-circular profile of the non-circular portion of the inner liquid-container. Aligning 210 may (but is not required to) be performed after positioning 204. For example, an outer shell 14 may be aligned radially with respect to an inner liquid-container 12 prior to being positioned in the at least partially overlapping, telescopic relation relative to the inner liquid-container.

As mentioned, some methods 200 according to the present disclosure further and optionally include (after the positioning 204) the attaching 212 of the outer shell to the inner liquid-container. For example, attaching 212 may include attaching the outer shell in the inner liquid-container to form a space 32 between the inner liquid-container and the outer shell. The attaching may be performed at an attaching region, such as coupling structure 40 and/or coupling structure 66 of the inner liquid-container and the outer shell, respectively. In some methods according to the present disclosure, the space 32 may be partially enclosed. In other examples, the space 32 may be fully enclosed. For example, attaching 212 may include forming a seal between the outer shell and the inner liquid-container at the attaching region. Such a seal may (but is not required to) be a hermetic seal. An illustrative, non-exclusive example of a process that may be used for the attaching 212 includes laser welding.

After the attaching 212, in some examples of multi-layered drink-containers 10 according to the present disclosure, the inner liquid-container and the outer shell may engage each other only at the attaching region.

As mentioned, some methods 200 according to the present disclosure further and optionally include (after the returning 206) the installing 214 of a cap 20 to one of the inner liquid-container and the outer shell of a multi-layered drink-container 10 according to the present disclosure.

Figure 9:
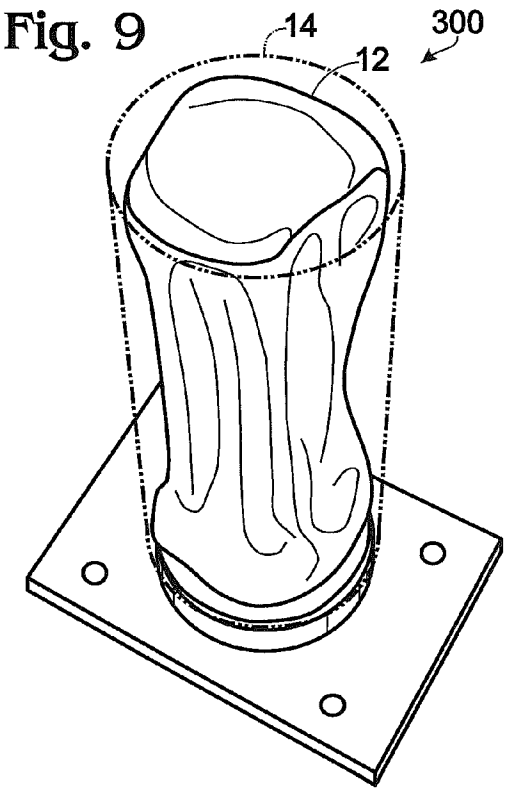
FIG. 9 is another isometric view of the assembly fixture of FIG. 8, the assembly fixture illustrated together with an inner liquid-container in a collapsed state and a schematic representation of an outer shell in an overlapping, telescopic relation to the inner liquid-container.
Figure 8:
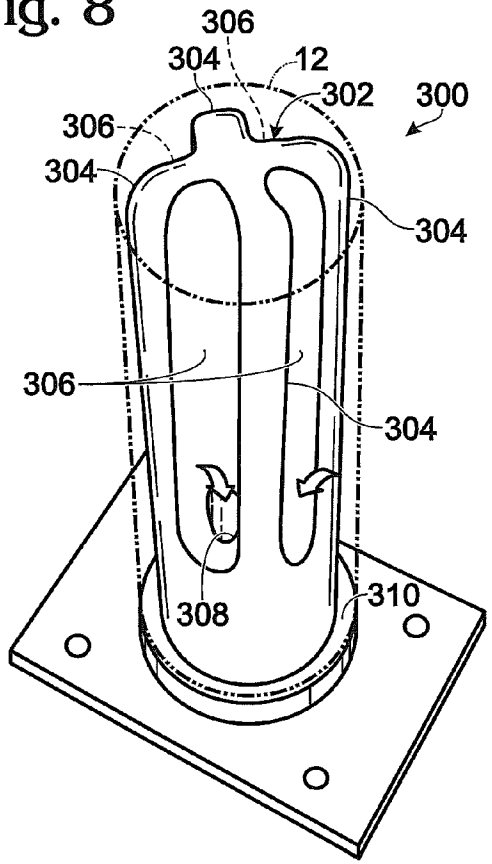
FIG. 8 is an isometric view of an illustrative, non-exclusive example of an assembly fixture that may be used according to an aspect of an illustrative, non-exclusive method of assembling a multi-layered drink-container according to the present disclosure, the assembly fixture illustrated together with a schematic representation of an inner liquid-container of a multi-layered drink-container according to the present disclosure in a neutral, un-deformed state.

As disclosed herein, the reducing 202 of an at least partially resiliently deformable inner liquid-container of a multi-layered drink-container 10 according to the present disclosure may (but is not required to) include applying a vacuum to an internal volume of the inner liquid-container to reduce the internal volume, the cross-sectional area, and/or the maximum outer-width of the resiliently deformable restrictive-portion of the inner liquid-container so that the outer shell can be positioned in the at least partially overlapping, telescopic relation relative to the inner liquid-container. FIGS. 8-9 illustrate an illustrative, non-exclusive example of an assembly fixture 300 that may be used to facilitate the reducing 202. Specifically, assembly fixture 300 is adapted to apply a vacuum to the internal volume of an inner liquid-container 12 such that the inner liquid-container collapses an amount sufficient to permit the positioning 204 of an outer shell and/or the positioning 208 of one or more optional sleeves 18 with respect to the inner liquid-container.

Assembly fixture 300 includes a nipple 302 sized to receive, and fit within the internal volume of, an inner liquid-container 12, which is schematically illustrated in FIG. 8 in dash-dot-dot lines. Nipple 302 includes four lobes 304 that define four cavities 306, from which four vacuum passages 308 extend into and through the nipple 302. Passages 308 are operatively connected to a vacuum mechanism that may be selectively activated by a user to suck, or otherwise displace, air from and around cavities 306 through passages 308.

Assembly fixture 300 further includes a surface 310, from which nipple 302 extends, against which the neck of an inner liquid-container 12 may be selectively positioned, and at which a generally air tight seal may be formed between the neck and the surface. Accordingly, upon placement of an inner liquid-container over nipple 300 and against surface 310, the vacuum mechanism may be activated by a user. As a result, a vacuum is applied to the internal volume of the inner liquid-container, and the inner liquid-container is forced to collapse around the lobes 304 of the nipple 302, as illustrated in FIG. 9, so that an outer shell 14 may subsequently be positioned over the collapsed inner liquid-container, as schematically illustrated in dash-dot-dot lines in FIG. 9.

Nipple 302, and thus lobes 304 and cavities 306 may be sized and/or shaped and/or otherwise configured to facilitate reduction of one or more of the internal volume of, an outer cross-sectional area of a restrictive portion of, and/or a maximum outer-width of a restrictive portion of, a liquid inner-container 12. Assembly fixtures that utilize a vacuum mechanism are not limited to the illustrative, non-exclusive assembly fixture 300 illustrated in FIGS. 8-9, and any suitable configuration may be used. For example, any suitable number of lobes and cavities and sizes thereof may be provided to facilitate collapsing of an inner liquid-container to a sufficient degree to permit positioning of an outer shell in an at least partially overlapping, telescopic relation relative to the inner liquid-container. Furthermore, as disclosed herein, methods of assembling multi-layered drink-containers according to the present disclosure are not limited to including applying a vacuum to the internal volume of an inner liquid-container, and the illustrated assembly fixture 300 of FIGS. 8-9 is only an illustrative, non-exclusive example of a fixture that may be used according to a method of the present disclosure.

The following enumerated paragraphs represent non-exclusive ways of describing inventions according to the present disclosure.

A A method of assembling a multi-layered drink-container comprised of at least an inner liquid-container and an outer shell, wherein the inner liquid-container includes a resiliently deformable restrictive-portion having a cross-sectional area bound by an outer perimeter defined within a plane that is transverse to the longitudinal axis of the inner liquid-container, wherein the outer shell includes a restrictive portion having a cross-sectional area bound by an inner perimeter defined within a plane that is transverse to the longitudinal axis of the outer shell, and wherein an orthogonal projection of the cross-sectional area of the resiliently deformable restrictive-portion at least partially overlaps an orthogonal projection of the cross-sectional area of the restrictive portion of the outer shell when the resiliently deformable restrictive-portion of the inner liquid-container is in a neutral, un-deformed state to define a neutral cross-sectional area of the resiliently deformable restrictive-portion, the method comprising:

reducing the cross-sectional area of the resiliently deformable restrictive-portion of the inner liquid-container from the neutral cross-sectional area to a reduced cross-sectional area in which an orthogonal projection of the reduced cross-sectional area does not overlap the orthogonal projection of the cross-sectional area of the restrictive portion of the outer shell;

after the reducing, positioning the outer shell in an at least partially overlapping, telescopic relation relative to the inner liquid-container such that the inner liquid-container extends at least partially within the outer shell so that the restrictive portion of the outer shell is longitudinally positioned beyond the resiliently deformable restrictive-portion of the inner liquid-container; and after the positioning the outer shell, returning the cross-sectional area of the resiliently deformable restrictive-portion of the inner liquid-container from the reduced cross-sectional area to the neutral cross-sectional area.

A1 The method of paragraph A, wherein the orthogonal projection of the cross-sectional area of the resiliently deformable restrictive-portion at least partially overlaps the orthogonal projection of the cross-sectional area of the portion of the outer shell regardless of radial orientation thereof, and wherein the orthogonal projection of the reduced cross-sectional area does not overlap the orthogonal projection of the cross-sectional area of the restrictive portion of the outer shell in at least one radial orientation.

A2 The method of any of paragraphs A-A1, wherein the reducing includes collapsing the resiliently deformable restrictive-portion of the inner liquid-container to reduce the cross-sectional area thereof so that the outer shell can be positioned in the at least partially overlapping, telescopic relation relative to the inner liquid-container.

A3 The method of any of paragraphs A-A1, wherein the reducing includes applying a width-reducing force to the resiliently deformable restrictive-portion of the inner-liquid container to reduce the cross-sectional area of the resiliently deformable restrictive-portion of the inner liquid-container so that the outer shell can be positioned in the at least partially overlapping, telescopic relation relative to the inner liquid-container; and wherein the returning includes releasing the width-reducing force from the resiliently deformable restrictive-portion so that the cross-sectional area of the resiliently deformable restrictive-portion returns to the neutral cross-sectional area.

A4 The method of any of paragraphs A-A1, wherein the reducing includes applying a volume-reducing force to the resiliently deformable restrictive-portion of the inner liquid-container to reduce an internal volume of the inner liquid-container so that the outer shell can be positioned in the at least partially overlapping, telescopic relation relative to the inner liquid-container; and wherein the returning includes releasing the volume-reducing force from the resiliently deformable restrictive-portion so that the cross-sectional area of the resiliently deformable restrictive-portion returns to the neutral cross-sectional area.

A5 The method of any of paragraphs A-A1, wherein the reducing includes applying a vacuum to an internal volume of the inner liquid-container to reduce the internal volume so that the outer shell can be positioned in the at least partially overlapping, telescopic relation relative to the inner liquid-container; and wherein the returning includes releasing the vacuum from the internal volume so that the cross-sectional area of the resiliently deformable restrictive-portion returns to the neutral cross-sectional area.

A6 The method of any of paragraphs A-A5, wherein the positioning the outer shell includes inserting the inner liquid-container into the outer shell.

A7 The method of any of paragraphs A-A5, wherein the positioning the outer shell includes positioning the outer shell at least partially around the inner liquid-container.

A8 The method of any of paragraphs A-A7, wherein in the at least partially overlapping, telescopic relation, the longitudinal axis of the inner liquid-container and the longitudinal axis of the outer shell are at least approximately coaxial.

A9 The method of any of paragraphs A-A8, wherein in the at least partially overlapping, telescopic relation, the inner liquid-container is partially within the outer shell.

A10 The method of any of paragraphs A-A7, wherein in the at least partially overlapping, telescopic relation, the inner liquid-container is at least substantially within the outer shell.

A11 The method of any of paragraphs A-A8, wherein in the at least partially overlapping, telescopic relation, the inner-liquid container is completely within the outer shell.

A12 The method of any of paragraphs A-A11, further comprising:

after the reducing and before the positioning the outer shell, positioning a sleeve in an at least partially overlapping, telescopic relation relative to the inner liquid-container such that the inner liquid-container extends at least partially within the sleeve.

A12.1 The method of paragraph A12, wherein the sleeve is constructed of a material having a thermal resistance greater than a thermal resistance of air.

A12.2 The method of paragraph A12, wherein the sleeve is constructed of a closed cell foam.

A12.3 The method of paragraph A12, wherein the sleeve is constructed of an aerogel.

A12.4 The method of any of paragraphs A12-A12.3, wherein the sleeve includes a restrictive portion having a cross-sectional area bound by an inner perimeter defined within a plane that is transverse to the longitudinal axis of the sleeve, and wherein the orthogonal projection of the neutral cross-sectional area of the resiliently deformable restrictive-portion of the inner liquid-container at least partially overlaps an orthogonal projection of the cross-sectional area of the restrictive portion of the sleeve, wherein the cross-sectional area of the restrictive portion of the sleeve is defined after the positioning.

A13 The method of any of paragraphs A-A12.4, wherein the inner liquid-container includes a non-circular portion with a non-circular profile and the outer shell includes a non-circular portion with a non-circular profile that corresponds to the non-circular portion of the inner liquid-container, wherein the non-circular profiles of the inner liquid-container and the outer shell are defined transverse to the longitudinal axes of the inner liquid-container and the outer shell, respectively, and wherein the method further comprises:

aligning the non-circular profile of the non-circular portion of the outer shell with the non-circular profile of the non-circular portion of the inner liquid-container.

A13.1 The method of paragraph A13, wherein the aligning is performed after the positioning the outer shell.

A14 The method of any of paragraphs A-A13.1, further comprising:

after the positioning the outer shell, attaching the outer shell to the inner liquid-container to form an enclosed space between the inner liquid-container and the outer shell, wherein the attaching defines an attaching region.

A14.1 The method of paragraph A14, wherein the attaching includes forming a seal between the outer shell and the inner liquid-container at the attaching region.

A14.2 The method of any of paragraphs A14-A14.1, wherein the attaching includes forming a hermetic seal between the outer shell and the inner liquid-container at the attaching region.

A14.3 The method of any of paragraphs A14-A14.2, wherein the attaching includes laser welding the outer shell to the inner liquid-container at the attaching region.

A14.4 The method of any of paragraphs A14-A14.3, wherein after the attaching, the inner liquid-container and the outer shell engage each other only at the attaching region.

A15 The method of any of paragraphs A-A14.4, wherein the outer shell includes a resiliently deformable portion.

A16 The method of any of paragraphs A-A15, wherein the inner liquid-container and the outer shell are both substantially resiliently deformable.

A17 The method of any of paragraphs A-A16, further comprising:

after the returning, coupling a cap to one of the inner liquid-container and the outer shell, wherein the cap is adapted to be selectively coupled to and decoupled from the one of the inner liquid-container and the outer shell.

A18 A multi-layered drink-container assembled according to the method of any of paragraphs A-A17.

B A method of assembling a multi-layered drink-container comprised of at least an inner liquid-container and an outer shell in an at least partially overlapping, telescopic relation relative to the inner liquid-container, wherein the inner liquid-container includes a resiliently deformable restrictive-portion having a cross-sectional area bound by an outer perimeter defined within a plane that is transverse to the longitudinal axis of the inner liquid-container, wherein the outer shell includes a restrictive portion that restricts positioning the outer shell in the at least partially overlapping, telescopic relation relative to the inner liquid-container without deformation of the resiliently deformable restrictive-portion of the inner liquid-container, the method comprising:

reducing the cross-sectional area of the resiliently deformable restrictive-portion of the inner liquid-container from a neutral cross-sectional area, in which the resiliently deformable restrictive-portion is in a neutral, un-deformed state, to a reduced cross-sectional area, in which the restrictive portion of the outer shell does not restrict positioning the outer shell in the at least partially overlapping, telescopic relation relative to the inner liquid-container;

after the reducing, positioning the outer shell in the at least partially overlapping, telescopic relation relative to the inner liquid-container such that the inner liquid-container extends at least partially within the outer shell so that the restrictive portion of the outer shell is longitudinally positioned beyond the resiliently deformable restrictive-portion of the inner liquid-container; and after the positioning the outer shell, returning the cross-sectional area of the resiliently deformable restrictive-portion from the reduced cross-sectional area to the neutral cross-sectional area.

B1 The method of paragraph B, wherein the reducing includes collapsing the resiliently deformable restrictive-portion of the inner liquid-container to reduce the cross-sectional area thereof so that the outer shell can be positioned in the at least partially overlapping, telescopic relation relative to the inner liquid-container.

B2 The method of paragraph B, wherein the reducing includes applying a width-reducing force to the resiliently deformable restrictive-portion of the inner-liquid container to reduce the cross-sectional area of the resiliently deformable restrictive-portion of the inner liquid-container so that the outer shell can be positioned in the at least partially overlapping, telescopic relation relative to the inner liquid-container; and wherein the returning includes releasing the width-reducing force from the resiliently deformable restrictive-portion so that the cross-sectional area of the resiliently deformable restrictive-portion returns to the neutral cross-sectional area.

B3 The method of paragraph B, wherein the reducing includes applying a volume-reducing force to the resiliently deformable restrictive-portion of the inner liquid-container to reduce an internal volume of the inner liquid-container so that the outer shell can be positioned in the at least partially overlapping, telescopic relation relative to the inner liquid-container; and wherein the returning includes releasing the volume-reducing force from the resiliently deformable restrictive-portion so that the cross-sectional area of the resiliently deformable restrictive-portion returns to the neutral cross-sectional area.

B4 The method of paragraph B, wherein the reducing includes applying a vacuum to an internal volume of the inner liquid-container to reduce the internal volume so that the outer shell can be positioned in the at least partially overlapping, telescopic relation relative to the inner liquid-container; and wherein the returning includes releasing the vacuum from the internal volume so that the cross-sectional area of the resiliently deformable restrictive-portion returns to the neutral cross-sectional area.

B5 The method of any of paragraphs B-B4, wherein the positioning the outer shell includes inserting the inner liquid-container into the outer shell.

B6 The method of any of paragraphs B-B4, wherein the positioning the outer shell includes positioning the outer shell at least partially around the inner liquid-container.

B7 The method of any of paragraphs B-B6, wherein in the at least partially overlapping, telescopic relation, the longitudinal axis of the inner liquid-container and the longitudinal axis of the outer shell are at least approximately coaxial.

B8 The method of any of paragraphs B-B7, wherein in the at least partially overlapping, telescopic relation, the inner liquid-container is partially within the outer shell.

B9 The method of any of paragraphs B-B7, wherein in the at least partially overlapping, telescopic relation, the inner liquid-container is at least substantially within the outer shell.

B10 The method of any of paragraphs B-B7, wherein in the overlapping, telescopic relation, the inner-liquid container is completely within the outer shell.

B11 The method of any of paragraphs B-B10, further comprising:

after the reducing and before the positioning the outer shell, positioning a sleeve in an at least partially overlapping, telescopic relation relative to the inner liquid-container such that the inner liquid-container extends at least partially within the sleeve.

B11.1 The method of paragraph B11, wherein the sleeve is constructed of a material having a thermal resistance greater than a thermal resistance of air.

B11.2 The method of paragraph B11, wherein the sleeve is constructed of a closed cell foam.

B11.3 The method of paragraph B11, wherein the sleeve is constructed of an aerogel.

B11.4 The method of any of paragraphs B11-B11.3, wherein the sleeve includes a restrictive portion that restricts positioning the sleeve in the at least partially overlapping, telescopic relation relative to the inner liquid-container without deformation of the resiliently deformable restrictive-portion of the inner liquid-container.

B12 The method of any of paragraphs B-B11.4, wherein the inner liquid-container includes a non-circular portion with a non-circular profile and the outer shell includes a non-circular portion with a non-circular profile that corresponds to the non-circular portion of the inner liquid-container, wherein the non-circular profiles of the inner liquid-container and the outer shell are defined transverse to the longitudinal axes of the inner liquid-container and the outer shell, respectively, and wherein the method further comprises:

aligning the non-circular profile of the non-circular portion of the outer shell with the non-circular profile of the non-circular portion of the inner liquid-container.

B12.1 The method of paragraph B12, wherein the aligning is performed after the positioning the outer shell.

B13 The method of any of paragraphs B-B12.1, further comprising:

after the positioning the outer shell, attaching the outer shell to the inner liquid-container to form an enclosed space between the inner liquid-container and the outer shell, wherein the attaching defines an attaching region.

B13.1 The method of paragraph B13, wherein the attaching includes forming a seal between the outer shell and the inner liquid-container at the attaching region.

B13.2 The method of any of paragraphs B13-B13.1, wherein the attaching includes forming a hermetic seal between the outer shell and the inner liquid-container at the attaching region.

B13.3 The method of any of paragraphs B13-B13.2, wherein the attaching includes laser welding the outer shell to the inner liquid-container at the attaching region.

B13.4 The method of any of paragraphs B13-B13.3, wherein after the attaching, the inner liquid-container and the outer shell engage each other only at the attaching region.

B14 The method of any of paragraphs B-B13.4, wherein the outer shell includes a resiliently deformable portion.

B15 The method of any of paragraphs B-B14, wherein the inner liquid-container and the outer shell are both substantially resiliently deformable.

B16 The method of any of paragraphs B-B15, further comprising:

after the returning, coupling a cap to one of the inner liquid-container and the outer shell, wherein the cap is adapted to be selectively coupled to and decoupled from the one of the inner liquid-container and the outer shell.

B17 A multi-layered drink-container assembled according to the method of any of paragraphs B-B16.

C A method of assembling a multi-layered drink-container comprised of at least an inner liquid-container and an outer shell, wherein the inner liquid-container includes a resiliently deformable restrictive-portion having a maximum-outer-width defined within a plane that is transverse to the longitudinal axis of the inner liquid-container, wherein the outer shell includes a restrictive portion having a minimum inner-width defined within a plane that is transverse to the longitudinal axis of the outer shell, and wherein the minimum inner-width is less than the maximum outer-width when the resiliently deformable restrictive-portion of the inner liquid-container is in a neutral, un-deformed state to define a neutral maximum-outer-width, the method comprising:

reducing the maximum outer-width of the resiliently deformable restrictive-portion of the inner liquid-container from the neutral maximum-outer-width to a reduced maximum-outer-width that is less than or equal to the minimum inner-width of the restrictive-portion of the outer shell;

after the reducing, positioning the outer shell in an at least partially overlapping, telescopic relation relative to the inner liquid-container such that the inner liquid-container extends at least partially within the outer shell; and after the positioning the outer shell, returning the maximum outer-width of the resiliently deformable restrictive-portion of the inner liquid-container from the reduced maximum-outer-width to the neutral maximum-outer-width.

C1 The method of paragraph C, wherein the reducing includes collapsing the resiliently deformable restrictive-portion of the inner liquid-container to reduce the maximum outer-width of the resiliently deformable restrictive-portion of the inner liquid-container so that the outer shell can be positioned in the at least partially overlapping, telescopic relation relative to the inner liquid-container.

C2 The method of paragraph C, wherein the reducing includes applying a width-reducing force to the resiliently deformable restrictive-portion of the inner-liquid container to reduce the maximum outer-width of the resiliently deformable restrictive-portion of the inner liquid-container so that the outer shell can be positioned in the at least partially overlapping, telescopic relation relative to the inner liquid-container; and wherein the returning includes releasing the width-reducing force from the resiliently deformable restrictive-portion so that the maximum outer-width returns to the neutral maximum-outer-width.

C3 The method of paragraph C, wherein the reducing includes applying a volume-reducing force to the resiliently deformable restrictive-portion of the inner liquid-container to reduce an internal volume of the resiliently deformable restrictive-portion so that the outer shell can be positioned in the at least partially overlapping, telescopic relation relative to the inner liquid-container; and wherein the returning includes releasing the volume-reducing force from the resiliently deformable restrictive-portion so that the maximum outer-width returns to the neutral maximum-outer width.

C4 The method of paragraph C, wherein the reducing includes applying a vacuum to an internal volume of the resiliently deformable restrictive-portion of the inner liquid-container to reduce the internal volume of the resiliently deformable restrictive-portion so that the outer shell can be positioned in the at least partially overlapping, telescopic relation relative to the inner liquid-container; and wherein the returning includes releasing the vacuum from the internal volume of the resiliently deformable restrictive-portion so that the maximum outer-width returns to the neutral maximum-outer width.

C5 The method of any of paragraphs C-C4, wherein the positioning the outer shell includes inserting the inner liquid-container into the outer shell.

C6 The method of any of paragraphs C-C4, wherein the positioning the outer shell includes positioning the outer shell at least partially around the inner liquid-container.

C7 The method of any of paragraphs C-C6, wherein in the at least partially overlapping, telescopic relation, the longitudinal axis of the inner liquid-container and the longitudinal axis of the outer shell are at least approximately coaxial.

C8 The method of any of paragraphs C-C7, wherein in the at least partially overlapping, telescopic relation, the inner liquid-container is partially within the outer shell.

C9 The method of any of paragraphs C-C7, wherein in the at least partially overlapping, telescopic relation, the inner liquid-container is at least substantially within the outer shell.

C10 The method of any of paragraphs C-C7, wherein in the at least partially overlapping, telescopic relation, the inner-liquid container is completely within the outer shell.

C11 The method of any of paragraphs C-C10, further comprising:

after the reducing and before the positioning the outer shell, positioning a sleeve in an at least partially overlapping, telescopic relation relative to the inner liquid-container such that the inner liquid-container extends at least partially within the sleeve.

C11.1 The method of paragraph C11, wherein the sleeve is constructed of a material having a thermal resistance greater than a thermal resistance of air.

C11.2 The method of paragraph C11, wherein the sleeve is constructed of a closed cell foam.

C11.3 The method of paragraph C11, wherein the sleeve is constructed of an aerogel.

C11.4 The method of any of paragraphs C11-C11.3, wherein the sleeve includes a portion having a minimum inner-width that is less than the neutral maximum-outer-width and greater than or equal to the reduced maximum-outer-width of the resiliently deformable restrictive-portion of the inner liquid-container, wherein the minimum inner-width of the portion of the sleeve is defined after the positioning the sleeve.

C12 The method of any of paragraphs C-C11.4, wherein the inner liquid-container includes a portion with a non-circular profile and the outer shell includes a portion with a non-circular profile that corresponds to the non-circular profile of the portion of the inner liquid-container, wherein the non-circular profiles of the inner liquid-container and the outer shell are defined transverse to the longitudinal axes of the inner liquid-container and the outer shell, respectively, and wherein the method further comprises:

aligning the non-circular profile of the portion of the outer shell with the non-circular profile of the portion of the inner liquid-container.

C12.1 The method of paragraph C12, wherein the aligning is performed after the positioning the outer shell.

C13 The method of any of paragraphs C-C12.1, further comprising:

after the positioning the outer shell, attaching the outer shell to the inner liquid-container to form an enclosed space between the inner liquid-container and the outer shell, wherein the attaching defines an attaching region.

C13.1 The method of paragraph C13, wherein the attaching includes forming a seal between the outer shell and the inner liquid-container at the attaching region.

C13.2 The method of any of paragraphs C13-C13.1, wherein the attaching includes forming a hermetic seal between the outer shell and the inner liquid-container at the attaching region.

C13.3 The method of any of paragraphs C13-C13.2, wherein the attaching includes laser welding the outer shell to the inner liquid-container at the attaching region.

C13.4 The method of any of paragraphs C13-C13.3, wherein after attaching, the inner liquid-container and the outer shell engage each other only at the attaching region.

C14 The method of any of paragraphs C-C13.4, wherein the outer shell includes a resiliently deformable portion.

C15 The method of any of paragraphs C-C14, wherein the inner liquid-container and the outer shell are both substantially resiliently deformable.

C16 The method of any of paragraph C-C15, further comprising:

after the returning, coupling a cap to one of the inner liquid-container and the outer shell, wherein the cap is adapted to be selectively coupled to and decoupled from one of the inner liquid-container and the outer shell.

C17 A multi-layered drink-container assembled according to the method of any of paragraphs C-C16.

D A multi-layered drink-container, comprising:

an inner liquid-container having an open top, a closed bottom, and an internal volume sized to hold a volume of potable drink liquid, wherein the inner liquid-container includes a lower portion having a cross-sectional area bound by an outer perimeter defined within a plane that is transverse to the longitudinal axis of the inner liquid-container; and an outer shell having an open top proximate the open top of the inner liquid-container and a closed bottom proximate the closed bottom of the inner liquid-container, the outer shell coupled to the inner liquid-container proximate one of the open top of the inner liquid-container and the open top of the outer shell, wherein the outer shell and the lower portion of the inner liquid-container are in a spaced-apart concentric relation that defines an enclosed space between the lower portion of the inner liquid-container and the outer shell, wherein the outer shell includes an upper portion proximate to the open top of the outer shell, the upper portion having a cross-sectional area bound by an inner perimeter defined within a plane that is transverse to the longitudinal axis of the outer shell, and wherein an orthogonal projection of the cross-sectional area of the lower portion of the inner liquid-container at least partially overlaps an orthogonal projection of the cross-sectional area of the upper portion of outer shell.

D1 The multi-layered drink-container of paragraph D, wherein the orthogonal projection of the cross-sectional area of the lower portion of the inner liquid-container at least partially overlaps the orthogonal projection of the cross-sectional area of the upper portion of the outer shell regardless of radial orientation thereof.

D2 The multi-layered drink-container of any of paragraphs D-D1, further comprising:

a cap coupled to one of the inner liquid-container and the outer shell.

D2.1 The multi-layered drink-container of paragraph D2, wherein the cap is removably coupled to the one of the inner liquid-container and the outer shell to form a fluid-tight interface therebetween.

D3 The multi-layered drink-container of any of paragraphs D-D2.1, wherein the lower portion of the inner liquid-container is resiliently deformable.

D4 The multi-layered drink-container of any of paragraphs D-D3, wherein the outer shell is resiliently deformable.

D5 The multi-layered drink-container of any of paragraphs D-D4, wherein the inner liquid-container and the outer shell are both substantially resiliently deformable.

D6 The multi-layered drink-container of any of paragraphs D-D5, further comprising:

a sleeve positioned in the enclosed space between the lower portion of the inner liquid-container and the outer shell.

D6.1 The multi-layered drink-container of paragraph D6, wherein the sleeve is constructed of a material having a thermal resistance greater than a thermal resistance of air.

D6.2 The multi-layered drink-container of paragraph D6, wherein the sleeve is constructed of a closed cell foam.

D6.3 The multi-layered drink-container of paragraph D6, wherein the sleeve is constructed of an aerogel.

D6.4 The multi-layered drink-container of any of paragraphs D6-D6.3, wherein the sleeve includes an upper portion having a cross-sectional area bound by an inner perimeter defined within a plane that is transverse to the longitudinal axis of the sleeve, and wherein the orthogonal projection of the lower portion of the inner liquid-container at least partially overlaps an orthogonal projection of the cross-sectional area of the upper portion of the sleeve, and wherein the upper portion of the sleeve is longitudinally above the lower portion of the inner liquid-container.

D7 The multi-layered drink-container of any of paragraphs D-D6.4, wherein the inner liquid-container includes a non-circular portion with a non-circular profile and the outer shell includes a non-circular portion with a non-circular profile that corresponds to the non-circular profile of the non-circular portion of the inner liquid-container, wherein the non-circular profiles of the inner liquid-container and the outer shell are aligned with each other and are defined transverse to the longitudinal axes of the inner liquid-container and the outer shell, respectively.

D8 The multi-layered drink-container of any of paragraphs D-D7, wherein the outer shell includes a lower portion spaced from the open top of the outer shell, the lower portion having a cross-sectional area bound by an inner perimeter defined within a plane that is transverse to the longitudinal axis of the outer shell, and wherein the orthogonal projection of the cross-sectional area of the lower portion of the inner liquid-container at least partially overlaps an orthogonal projection of the cross-sectional area of the lower portion of the outer shell, and wherein the lower portion of the outer shell is longitudinally between the open top of the outer shell and the lower portion of the inner liquid-container.

D9 The multi-layered drink-container of any of paragraphs D-D8, wherein the outer shell is coupled to the inner liquid-container at an attaching region that defines a hermetic seal.

D10 The multi-layered drink-container of any of paragraphs D-D9, wherein the inner liquid-container and the outer shell are both substantially resiliently deformable;

wherein the outer shell includes a lower portion spaced from the open top of the outer shell, the lower portion having a cross-sectional area bound by an inner perimeter defined within a plane that is transverse to the longitudinal axis of the outer shell, and wherein the orthogonal projection of the cross-sectional area of the lower portion of the inner liquid-container at least partially overlaps an orthogonal projection of the cross-sectional area of the lower portion of the outer shell, and wherein the lower portion of the outer shell is longitudinally between the open top of outer shell and the lower portion of the inner liquid-container.

D10.1 The multi-layered drink-container of paragraph D10, wherein the inner liquid-container includes a non-circular portion with a non-circular profile and the outer shell includes a non-circular portion with a non-circular profile that corresponds to the non-circular profile of the non-circular portion of the inner liquid-container, wherein the non-circular profiles of the inner liquid-container and the outer shell are aligned with each other and are defined transverse to the longitudinal axes of the inner liquid-container and the outer shell, respectively.

D10.2 The multi-layered drink-container of any of paragraphs D10-D10.1, wherein the outer shell is coupled to the inner liquid-container at an attaching region that defines a hermetic seal.

D10.3 The multi-layered drink-container of any of paragraphs D10-D10.2, further comprising:

a cap coupled to one of the inner liquid-container and the outer shell.

D10.3.1 The multi-layered drink-container of paragraph D10.3, wherein the cap is removably coupled to the one of the inner liquid-container and the outer shell to form a fluid-tight interface therebetween.

D10.4 The multi-layered drink-container of any of paragraphs D10-D10.3.1, further comprising:

a sleeve positioned in the enclosed space between the lower portion of the inner liquid-container and the outer shell.

D10.4.1 The multi-layered drink-container of paragraph D10.4, wherein the sleeve is constructed of a material having a thermal resistance greater than a thermal resistance of air.

D10.4.2 The multi-layered drink-container of paragraph D10.4, wherein the sleeve is constructed of a closed cell foam.

D10.4.3 The multi-layered drink-container of paragraph D10.4, wherein the sleeve is constructed of an aerogel.

D10.4.4 The multi-layered drink-container of any of paragraphs D10.4-D10.4.3, wherein the sleeve includes an upper portion having a cross-sectional area bound by an inner perimeter defined within a plane that is transverse to the longitudinal axis of the sleeve, and wherein the orthogonal projection of the lower portion of the inner liquid-container at least partially overlaps an orthogonal projection of the cross-sectional area of the upper portion of the sleeve, and wherein the upper portion of the sleeve is longitudinally above the lower portion of the inner liquid-container.

E A multi-layered drink-container, comprising:

an inner liquid-container having an open top, a closed bottom, and an internal volume sized to hold a volume of potable drink liquid, wherein the inner liquid-container includes a lower portion having a maximum outer-width defined within a plane that is transverse to the longitudinal axis of the inner liquid-container; and an outer shell having an open top proximate the open top of the inner liquid-container and a closed bottom proximate the closed bottom of the inner liquid-container, the outer shell coupled to the inner liquid-container proximate one of the open top of the inner liquid-container and the open top of the outer shell, wherein the outer shell and the lower portion of the inner liquid-container are in a spaced-apart concentric relation that defines an enclosed space between the lower portion of the inner liquid-container and the outer shell, wherein the outer shell includes an upper portion proximate to the open top of the outer shell, the upper portion having a minimum inner-width defined within a plane that is transverse to the longitudinal axis of the outer shell, and wherein the minimum inner-width of the open top of the outer shell is less than the maximum-outer-width of the lower portion of the inner liquid-container.

E1 The multi-layered drink-container of paragraph E, further comprising:

a cap coupled to one of the inner liquid-container and the outer shell.

E1.1 The multi-layered drink-container of paragraph E1, wherein the cap is removably coupled to the one of the inner liquid-container and the outer shell to form a fluid-tight interface therebetween.

E2 The multi-layered drink-container of any of paragraphs E-E1.1, wherein the lower portion of the inner liquid-container is resiliently deformable.

E3 The multi-layered drink-container of any of paragraphs E-E2, wherein the outer shell is resiliently deformable.

E4 The multi-layered drink-container of any of paragraphs E-E1.1, wherein the inner liquid-container and the outer shell are both substantially resiliently deformable.

E5 The multi-layered drink-container of any of paragraphs E-E4, further comprising:

a sleeve positioned in the enclosed space between the between the lower portion of the inner liquid-container and the outer shell.

E5.1 The multi-layered drink-container of paragraph E5, wherein the sleeve is constructed of a material having a thermal resistance greater than a thermal resistance of air.

E5.2 The multi-layered drink-container of paragraph E5, wherein the sleeve is constructed of a closed cell foam.

E5.3 The multi-layered drink-container of paragraph E5, wherein the sleeve is constructed of an aerogel.

E5.4 The multi-layered drink-container of any of paragraphs E5-E5.3, wherein the sleeve includes an upper portion having a minimum inner-width defined within a plane that is transverse to the longitudinal axis of the sleeve, and wherein the minimum inner-width of the upper portion of the sleeve is less than the maximum outer-width of the lower portion of the inner liquid-container, and wherein the upper portion of the sleeve is longitudinally above the lower portion of the inner liquid-container.

E6 The multi-layered drink-container of any of paragraphs E-E5.4, wherein the inner liquid-container includes a portion with a non-circular profile and the outer shell includes a portion with a non-circular profile that corresponds to the non-circular profile of the portion of the inner liquid-container, wherein the non-circular profiles of the inner liquid-container and the outer shell are aligned with each other and are defined transverse to the longitudinal axes of the inner liquid-container and the outer shell, respectively.

E7 The multi-layered drink-container of paragraphs E-E6, wherein the outer shell includes a lower portion spaced from the open top of the outer shell, the lower portion having a minimum-inner-width defined within a plane that is transverse to the longitudinal axis of the outer shell, and wherein the minimum inner-width of the lower portion is less than the maximum-outer-width of the lower portion of the inner liquid-container, and wherein the lower portion of the outer shell is longitudinally between the open top of outer shell and the lower portion of the inner liquid-container.

E8 The multi-layered drink-container of any of paragraphs E-E7, wherein the outer shell is coupled to the inner liquid-container at an attaching region that defines a hermetic seal.

E9 The multi-layered drink-container of any of paragraphs E-E8, wherein the inner liquid-container and the outer shell are both substantially resiliently deformable;

wherein the outer shell includes a lower portion spaced from the open top of the outer shell, the lower portion having a minimum-inner-width defined within a plane that is transverse to the longitudinal axis of the outer shell, and wherein the minimum inner-width of the lower portion is less than the maximum-outer-width of the lower portion of the inner liquid-container, and wherein the lower portion of the outer shell is longitudinally between the open top of the outer shell and the lower portion of the inner liquid-container.

E9.1 The multi-layered drink-container of paragraph E9, wherein the inner liquid-container includes a portion with a non-circular profile and the outer shell includes a portion with a non-circular profile that corresponds to the non-circular profile of the portion of the inner liquid-container, wherein the non-circular profiles of the inner liquid-container and the outer shell are aligned with each other and are defined transverse to the longitudinal axes of the inner liquid-container and the outer shell, respectively.

E9.2 The multi-layered drink-container of any of paragraphs E9-E9.1, wherein the outer shell is coupled to the inner liquid-container at an attaching region that defines a hermetic seal.

E9.3 The multi-layered drink-container of any of paragraphs E9-E9.2, further comprising:

a cap coupled to one of the inner liquid-container and the outer shell.

E9.3.1 The multi-layered drink-container of paragraph E9.3, wherein the cap is removably coupled to the one of the inner liquid-container and the outer shell to form a fluid-tight interface therebetween.

E9.4 The multi-layered drink-container of any of paragraphs E9-E9.3.1, further comprising:

a sleeve positioned in the enclosed space between the lower portion of the inner liquid-container and the outer shell.

E9.4.1 The multi-layered drink-container of paragraph E9.4, wherein the sleeve is constructed of a material having a thermal resistance greater than a thermal resistance of air.

E9.4.2 The multi-layered drink-container of paragraph E9.4, wherein the sleeve is constructed of a closed cell foam.

E9.4.3 The multi-layered drink-container of paragraph E9.4, wherein the sleeve is constructed of an aerogel.

E9.4.4 The multi-layered drink-container of any of paragraphs E9.4-E9.4.3, wherein the sleeve includes an upper portion having a minimum inner-width defined within a plane that is transverse to the longitudinal axis of the sleeve, and wherein the minimum inner-width of the upper portion of the sleeve is less than the maximum outer-width of the lower portion of the inner liquid-container, and wherein the upper portion of the sleeve is longitudinally above the lower portion of the inner liquid-container.

The disclosure set forth above encompasses multiple distinct inventions with independent utility. While each of these inventions has been disclosed in a preferred form or method, the specific alternatives, embodiments, and/or methods thereof as disclosed and illustrated herein are not to be considered in a limiting sense, as numerous variations are possible. The present disclosure includes all novel and non-obvious combinations and subcombinations of the various elements, features, functions, properties, methods and/or steps disclosed herein. Similarly, where any disclosure above or claim below recites "a" or "a first" element, step of a method, or the equivalent thereof, such disclosure or claim should be understood to include one or more such elements or steps, neither requiring nor excluding two or more such elements or steps.

Inventions embodied in various combinations and subcombinations of features, functions, elements, properties, steps and/or methods may be claimed through presentation of new claims in a related application. Such new claims, whether they are directed to a different invention or directed to the same invention, whether different, broader, narrower, or equal in scope to the original paragraphs, are also regarded as included within the subject matter of the present disclosure.

INDUSTRIAL APPLICABILITY

The drink containers of the present disclosure are applicable to the hydration fields, and are specifically applicable to portable drink containers from which users may selectively drink potable drink liquid.

The invention claimed is:

1. A method of assembling a multi-layered drink-container comprised of at least an inner liquid-container and an outer shell, wherein the inner liquid-container includes a resiliently deformable restrictive-portion having a cross-sectional area bound by an outer perimeter defined within a plane that is transverse to the longitudinal axis of the inner liquid-container, wherein the outer shell includes a restrictive portion having a cross-sectional area bound by an inner perimeter defined within a plane that is transverse to the longitudinal axis of the outer shell, and wherein an orthogonal projection of the cross-sectional area of the resiliently deformable restrictive-portion at least partially overlaps an orthogonal projection of the cross-sectional area of the restrictive portion of the outer shell when the resiliently deformable restrictive-portion of the inner liquid-container is in a neutral, un-deformed state to define a neutral cross-sectional area of the resiliently deformable restrictive-portion, the method comprising:

reducing the cross-sectional area of the resiliently deformable restrictive-portion of the inner liquid-container from the neutral cross-sectional area to a reduced cross-sectional area in which an orthogonal projection of the reduced cross-sectional area does not overlap the orthogonal projection of the cross-sectional area of the restrictive portion of the outer shell;

after the reducing, positioning the outer shell in an at least partially overlapping, telescopic relation relative to the inner liquid-container such that the inner liquid-container extends at least partially within the outer shell so that the restrictive portion of the outer shell is longitudinally positioned beyond the resiliently deformable restrictive-portion of the inner liquid-container; and after the positioning the outer shell, returning the cross-sectional area of the resiliently deformable portion of the inner liquid-container from the reduced cross-sectional area to the neutral cross-sectional area.

2. The method of claim 1, wherein the orthogonal projection of the cross-sectional area of the resiliently deformable restrictive-portion at least partially overlaps the orthogonal projection of the cross-sectional area of the portion of the outer shell regardless of radial orientation thereof, and wherein the orthogonal projection of the reduced cross-sectional area does not overlap the orthogonal projection of the cross-sectional area of the restrictive portion of the outer shell in at least one radial orientation.

3. The method of claim 1, wherein the reducing includes collapsing the resiliently deformable restrictive-portion of the inner liquid-container to reduce the cross-sectional area thereof so that the outer shell can be positioned in the at least partially overlapping, telescopic relation relative to the inner liquid-container.

4. The method of claim 1, wherein the reducing includes applying a width-reducing force to the resiliently deformable restrictive-portion of the inner-liquid container to reduce the cross-sectional area of the resiliently deformable restrictive-portion of the inner liquid-container so that the outer shell can be positioned in the at least partially overlapping, telescopic relation relative to the inner liquid-container; and wherein the returning includes releasing the width-reducing force from the resiliently deformable restrictive-portion so that the cross-sectional area of the resiliently deformable restrictive-portion returns to the neutral cross-sectional area.

5. The method of claim 1, wherein the reducing includes applying a volume-reducing force to the resiliently deformable restrictive-portion of the inner liquid-container to reduce an internal volume of the inner liquid-container so that the outer shell can be positioned in the at least partially overlapping, telescopic relation relative to the inner liquid-container; and wherein the returning includes releasing the volume-reducing force from the resiliently deformable restrictive-portion so that the cross-sectional area of the resiliently deformable restrictive-portion returns to the neutral cross-sectional area.

6. The method of claim 1, wherein the reducing includes applying a vacuum to an internal volume of the inner liquid-container to reduce the internal volume so that the outer shell can be positioned in the at least partially overlapping, telescopic relation relative to the inner liquid-container; and wherein the returning includes releasing the vacuum from the internal volume so that the cross-sectional area of the resiliently deformable restrictive-portion returns to the neutral cross-sectional area.

7. The method of claim 1, wherein the positioning the outer shell includes inserting the inner liquid-container into the outer shell.

8. The method of claim 1, wherein the positioning the outer shell includes positioning the outer shell at least partially around the inner liquid-container.

9. The method of claim 1, wherein in the at least partially overlapping, telescopic relation, the longitudinal axis of the inner liquid-container and the longitudinal axis of the outer shell are at least approximately coaxial.

10. The method of claim 1, wherein in the at least partially overlapping, telescopic relation, the inner-liquid container is at least substantially within the outer shell.

11. The method of claim 1, wherein in the at least partially overlapping, telescopic relation, the inner-liquid container is completely within the outer shell.

12. The method of claim 1, further comprising:

after the reducing and before the positioning the outer shell, positioning a sleeve in an at least partially overlapping, telescopic relation relative to the inner liquid-container such that the inner liquid-container extends at least partially within the sleeve.

13. The method of claim 12, wherein the sleeve is constructed of a material having a thermal resistance greater than a thermal resistance of air.

14. The method of claim 12, wherein the sleeve includes a restrictive portion having a cross-sectional area bound by an inner perimeter defined within a plane that is transverse to the longitudinal axis of the sleeve, and wherein the orthogonal projection of the neutral cross-sectional area of the resiliently deformable restrictive-portion of the inner liquid-container at least partially overlaps an orthogonal projection of the cross-sectional area of the restrictive portion of the sleeve, wherein the cross-sectional area of the restrictive portion of the sleeve is defined after the positioning.

15. The method of claim 1, wherein the inner liquid-container includes a non-circular portion with a non-circular profile and the outer shell includes a non-circular portion with a non-circular profile that corresponds to the non-circular portion of the inner liquid-container, wherein the non-circular profiles of the inner liquid-container and the outer shell are defined transverse to the longitudinal axes of the inner liquid-container and the outer shell, respectively, and wherein the method further comprises:

aligning the non-circular profile of the non-circular portion of the outer shell with the non-circular profile of the non-circular portion of the inner liquid-container.

16. The method of claim 1, further comprising:

after the positioning the outer shell, attaching the outer shell to the inner liquid-container to form an enclosed space between the inner liquid-container and the outer shell, wherein the attaching defines an attaching region.

17. The method of claim 16, wherein the attaching includes forming a seal between the outer shell and the inner liquid-container at the attaching region.

18. The method of claim 16, wherein the attaching includes forming a hermetic seal between the outer shell and the inner liquid-container at the attaching region.

19. The method of claim 16, wherein after the attaching, the inner liquid-container and the outer shell engage each other only at the attaching region.

20. The method of claim 1, wherein the outer shell includes a resiliently deformable portion.

21. The method of claim 1, wherein the inner liquid-container and the outer shell are both substantially resiliently deformable.

22. The method of claim 1, further comprising:

after the returning, coupling a cap to one of the inner liquid-container and the outer shell, wherein the cap is adapted to be selectively coupled to and decoupled from the one of the inner liquid-container and the outer shell.

23. A method of assembling a multi-layered drink-container comprised of at least an inner liquid-container and an outer shell in an at least partially overlapping, telescopic relation relative to the inner liquid-container, wherein the inner liquid-container includes a resiliently deformable restrictive-portion having a cross-sectional area bound by an outer perimeter defined within a plane that is transverse to the longitudinal axis of the inner liquid-container, wherein the outer shell includes a restrictive portion that restricts positioning the outer shell in the at least partially overlapping, telescopic relation relative to the inner liquid-container without deformation of the resiliently deformable restrictive-portion of the inner liquid-container, the method comprising:

reducing the cross-sectional area of the resiliently deformable restrictive-portion of the inner liquid-container from a neutral cross-sectional area, in which the resiliently deformable restrictive-portion is in a neutral, undeformed state, to a reduced cross-sectional area, in which the restrictive portion of the outer shell does not restrict positioning the outer shell in the at least partially overlapping, telescopic relation relative to the inner liquid-container;

after the reducing, positioning the outer shell in the at least partially overlapping, telescopic relation relative to the inner liquid-container such that the inner liquid-container extends at least partially within the outer shell so that the restrictive portion of the outer shell is longitudinally positioned beyond the resiliently deformable restrictive-portion of the inner liquid-container; and after the positioning the outer shell, returning the cross-sectional area of the resiliently deformable restrictive-portion from the reduced cross-sectional area to the neutral cross-sectional area.

* * * * *